US010899568B2

(12) United States Patent
Pasquale

(10) Patent No.: US 10,899,568 B2
(45) **Date of Patent: *Jan. 26, 2021**

(54) AUTOMATIC LAPLESS BUTT MATERIAL SPLICE

(71) Applicant: New Era Converting Machinery, Inc., Paterson, NJ (US)

(72) Inventor: Robert A Pasquale, Hawthorne, NJ (US)

(73) Assignee: New Era Converting Machinery, Inc., Paterson, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/566,313

(22) Filed: Sep. 10, 2019

(65) Prior Publication Data

US 2020/0140219 A1 May 7, 2020

Related U.S. Application Data

(63) Continuation of application No. 15/269,290, filed on Sep. 19, 2016, now Pat. No. 10,457,512.

(51) Int. Cl.
*B65H 19/18* (2006.01)
*B65H 21/00* (2006.01)
*B65H 19/10* (2006.01)

(52) U.S. Cl.
CPC ..... *B65H 19/1826* (2013.01); *B65H 19/102* (2013.01); *B65H 19/1821* (2013.01);
(Continued)

(58) Field of Classification Search
CPC .... B65H 19/1826; B65H 21/00; B65H 19/02; B65H 19/1836; B65H 19/1821;
(Continued)

(56) References Cited

U.S. PATENT DOCUMENTS 1,318,092 A 10/1919 Focke et al.
2,386,346 A † 10/1945 Roesen
(Continued)

FOREIGN PATENT DOCUMENTS

CA 2383553 C 9/2009
CN 101081667 A 12/2007
(Continued)

OTHER PUBLICATIONS

"U.S. Appl. No. 15/269,290, Non Final Office Action dated Dec. 13, 2018", 9 pgs.

(Continued)

*Primary Examiner* — William A. Rivera
(74) *Attorney, Agent, or Firm* — Schwegman Lundberg & Woessner, P.A.

(57) ABSTRACT

Devices, methods, and systems for splicing a trailing edge of an outgoing roll with a leading edge of a replacement roll with a lapless butt splice on-the-fly during converting and printing production. A first strip of adhesive tape may be placed partially under the leading edge, such that a portion of the adhesive tape remains exposed beyond the leading edge. The replacement roll may be accelerated to match the speed of the outgoing web's movement, a trailing edge of the outgoing web may be cut free from the outgoing roll, and the trailing edge of the outgoing roll may be positioned over the exposed portion of the adhesive tape. A second strip of adhesive tape may be applied over the leading edge and trailing edge using a splicer roller timed to apply the tape when the edges pass proximate to the splicer roller.

19 Claims, 16 Drawing Sheets

(52) U.S. Cl.
CPC ..... *B65H 19/1836* (2013.01); *B65H 21/00* (2013.01); *B65H 2301/4631* (2013.01); *B65H 2301/46072* (2013.01); *B65H 2301/46075* (2013.01); *B65H 2301/46222* (2013.01); *B65H 2301/46414* (2013.01)

(58) Field of Classification Search
CPC ..... B65H 2301/46414; B65H 2301/46075; B65H 230/46072; B65H 2301/46222; B65H 2301/4631; B26D 1/151; B26D 5/12; B29C 65/5057; B29C 65/52; B29C 65/80; F16B 11/006
See application file for complete search history.

(56) References Cited

U.S. PATENT DOCUMENTS 3,024,157 A † 3/1962 Beerli
3,243,337 A † 3/1966 Haselow
3,253,795 A † 5/1966 Peurod
3,401,745 A 9/1968 Georges et al.
3,467,334 A 9/1969 Chesnut et al.
3,514,363 A † 5/1970 Horace
3,567,334 A † 3/1971 Kushiro
3,654,035 A † 4/1972 Takimoto
3,915,399 A 10/1975 Kron et al.
4,151,594 A † 4/1979 Stern
4,214,943 A † 7/1980 Stern
4,234,365 A 11/1980 Shimizu et al.
4,238,261 A † 12/1980 Tetro
4,363,695 A 12/1982 Marass
4,492,609 A 1/1985 Blom
4,535,230 A 8/1985 Brieu
4,543,152 A † 9/1985 Nozaka
4,581,083 A † 4/1986 Schutz
4,683,628 A 8/1987 Schonemann
4,769,098 A 9/1988 Cederholm et al.
4,878,982 A † 11/1989 Ogata
4,923,546 A 5/1990 Wheeler et al.
4,967,974 A † 11/1990 Kawamura
5,019,203 A 5/1991 Singer
5,045,134 A † 9/1991 Schenker
5,188,691 A 2/1993 Caputo
5,241,159 A 8/1993 Chatteriee et al.
5,356,496 A † 10/1994 Lincoln
5,562,038 A † 10/1996 Bierbaum
5,571,368 A 11/1996 Barge
5,698,060 A 12/1997 Long
5,738,744 A 4/1998 Washizaki et al.
5,760,375 A 6/1998 Hall
5,779,184 A † 7/1998 Kaufmann
5,845,867 A † 12/1998 Hould
5,881,964 A 3/1999 Fujikura et al.
5,954,292 A 9/1999 Nawano et al.
5,975,457 A 11/1999 Forbes
6,016,989 A 1/2000 Gangemi
6,027,591 A 2/2000 Odwyer
6,050,517 A † 4/2000 Dobrescu
6,051,095 A 4/2000 Butterworth
6,079,470 A 6/2000 Pielke et al.
6,079,661 A 6/2000 Klimek et al.
6,096,150 A 8/2000 Ohno
6,161,604 A 12/2000 Richards et al.
6,189,587 B1 2/2001 Cairns
6,273,168 B1 † 8/2001 Kawamura
6,364,244 B1 4/2002 Pasquale et al.
6,481,664 B1 11/2002 Bravin
6,536,087 B2 3/2003 Stuettem
6,578,616 B2 6/2003 Stein et al.
6,588,696 B1 7/2003 Riihelae et al.
6,616,086 B2 9/2003 Nakamura et al.
6,695,027 B2 2/2004 Hashimoto
6,705,560 B1 3/2004 Raagaard et al.
6,719,239 B2 4/2004 Suzuki et al.
6,758,431 B2 7/2004 Trutschel
6,758,432 B1 7/2004 Rufo
6,764,040 B2 7/2004 Kiyota
6,792,987 B2 9/2004 Monroe
6,808,581 B2 10/2004 Kuta et al.
6,811,636 B2 11/2004 Hebels et al.
6,811,637 B2 11/2004 Pelagatti et al.
6,814,123 B2 11/2004 Erickson
6,817,566 B2 11/2004 Clifford et al.
6,820,836 B2 11/2004 Sato et al.
6,820,837 B2 11/2004 Long
6,841,020 B2 1/2005 Hebels et al.
6,880,604 B2 4/2005 Keene
6,881,289 B2 4/2005 Borderi et al.
6,941,994 B2 9/2005 Kushihashi et al.
6,966,961 B2 11/2005 Adami
6,978,816 B1 12/2005 Byrne et al.
6,978,963 B2 12/2005 Suzuki et al.
6,981,537 B2 1/2006 Cyr et al.
7,022,205 B2 4/2006 Ward et al.
7,037,397 B2 5/2006 Bean et al.
7,078,082 B2 7/2006 Adams
7,086,627 B2 8/2006 Kehler et al.
7,128,795 B2 10/2006 Byrne et al.
7,138,033 B2 11/2006 Hayasaka
7,156,340 B2 1/2007 Shiraishi et al.
7,201,345 B2 4/2007 Werner et al.
7,240,873 B2 7/2007 Eikmeier et al.
7,240,874 B2 7/2007 Eikmeier et al.
7,240,875 B2 7/2007 Hernandez et al.
7,264,194 B2 9/2007 Gassner et al.
7,306,184 B2 12/2007 Tafel
7,322,541 B2 1/2008 Fairchild
7,350,740 B2 4/2008 Benvenuti et al.
7,441,579 B2 10/2008 Adami
7,500,634 B2 3/2009 Benvenuti et al.
7,516,916 B2 4/2009 Titz et al.
7,597,282 B2 10/2009 Endo et al.
7,726,598 B2 6/2010 Morelli et al.
7,776,172 B2 8/2010 Tonohara
7,833,375 B2 11/2010 Tanaka et al.
7,938,925 B2 5/2011 Cummings et al.
7,980,504 B2 7/2011 Butterworth
8,002,924 B2 8/2011 Machamer
8,011,409 B2 9/2011 Adami
8,062,450 B2 11/2011 Odawara et al.
8,070,087 B2 12/2011 Maness et al.
8,088,238 B2 1/2012 Hafner
8,191,596 B2 6/2012 Hamlyn et al.
8,382,025 B2 2/2013 Mueller
8,606,138 B2 12/2013 Okano et al.
9,067,750 B2 6/2015 Casey et al.
9,206,012 B2 12/2015 Crozier et al.
9,321,604 B2 4/2016 Torres Martinez
9,469,494 B2 10/2016 Cederholm et al.
9,540,201 B2 1/2017 Talvitie
9,637,340 B1 5/2017 Butler et al.
9,670,020 B2 6/2017 Morelli et al.
9,670,022 B2 6/2017 Machamer
9,731,922 B2 8/2017 Chi
9,751,720 B2 9/2017 Garner et al.
10,457,512 B2 * 10/2019 Pasquale ..... B65H 19/1821
2002/0046812 A1 4/2002 Muller et al.
2002/0179769 A1 12/2002 Dreckmann et al.
2003/0168548 A1 9/2003 Kinnunen et al.
2004/0011896 A1 1/2004 Fochtman et al.
2004/0074590 A1 4/2004 Canti et al.
2004/0118964 A1 6/2004 Long
2004/0182497 A1 9/2004 Lowrey
2007/0060457 A1 3/2007 Bomba et al.
2008/0023126 A1 † 1/2008 Hould
2009/0092779 A1 4/2009 Nagel et al.
2010/0170978 A1 7/2010 Muller
2014/0057769 A1 2/2014 Steinemann et al.
2014/0119748 A1 5/2014 Priebe et al.
2014/0131504 A1 5/2014 Ramteke et al.
2014/0190953 A1 7/2014 Chan
2015/0219264 A1 8/2015 Tailor et al.
2015/0291380 A1 10/2015 Fischer et al.
2016/0279018 A1 9/2016 Egan et al.

(56) References Cited

U.S. PATENT DOCUMENTS

| | | | |
|---|---|---|---|
| 2017/0291784 | A1 | 10/2017 | Adami |
| 2017/0313461 | A1 | 11/2017 | Saccardi et al. |
| 2017/0341894 | A1 | 11/2017 | Muller |
| 2018/0079614 | A1 | 3/2018 | Pasquale |

FOREIGN PATENT DOCUMENTS

| | | | | |
|---|---|---|---|---|
| CN | 105923441 | A | | 9/2016 |
| CN | 106348069 | A | | 1/2017 |
| DE | 2118984 | | † | 7/1976 |
| DE | 102005010303 | B3 | | 9/2006 |
| DE | 102013109427 | A1 | | 3/2015 |
| EP | 0882412 | B1 | | 1/2002 |
| EP | 1162164 | B1 | | 2/2004 |
| EP | 1647509 | A2 | | 4/2006 |
| EP | 1897830 | B1 | | 3/2010 |
| EP | 1810942 | B1 | | 6/2010 |
| EP | 1640301 | B1 | | 6/2011 |
| EP | 1801058 | B1 | | 2/2012 |
| EP | 2702000 | B1 | | 4/2016 |
| EP | 1648805 | B1 | | 6/2016 |
| EP | 2845827 | B1 | | 1/2017 |
| EP | 2941111 | B1 | | 3/2017 |
| EP | 3296241 | A1 | | 3/2018 |
| JP | 04213480 | A | | 8/1992 |
| JP | 06267650 | A | | 9/1994 |
| JP | 2001210459 | A | | 8/2001 |
| JP | 2003036963 | A | | 2/2003 |
| JP | 2003-072994 | | † | 3/2003 |
| JP | 2005145708 | A | | 6/2005 |
| JP | 2007-168223 | A | | 7/2007 |
| JP | 3974916 | B2 | | 9/2007 |
| JP | 2010071624 | A | | 4/2010 |
| JP | 4886598 | B2 | | 2/2012 |
| JP | 5258741 | B2 | | 5/2013 |
| KR | 101653253 | B1 | | 9/2016 |
| WO | WO-9534496 | A1 | | 12/1995 |
| WO | WO-0224562 | A2 | | 3/2002 |
| WO | WO-03093152 | A1 | | 11/2003 |
| WO | WO-2004011356 | A1 | | 2/2004 |
| WO | 2004/080868 | | † | 9/2004 |
| WO | WO 2004/080868 | | † | 9/2004 |
| WO | WO-2015111571 | A1 | | 7/2015 |
| WO | WO-2016157438 | A1 | | 10/2016 |
| WO | WO-2018011984 | A1 | | 1/2018 |

OTHER PUBLICATIONS

"U.S. Appl. No. 15/269,290, Notice of Allowance dated Aug. 27, 2019", 5 pgs.

"U.S. Appl. No. 15/269,290, Response filed May 8, 2019 to on Final Office Action dated Dec. 13, 2018", 10 pgs.

"European Application Serial No. 16200742.1, Extended European Search Report dated Dec. 12, 2017", 10 pgs.

"European Application Serial No. 16200742.1, Partial European Search Report dated Jul. 31, 2017", 6 pgs.

"European Application Serial No. 16200742.1, Response filed Sep. 21, 2018 to Extended European Search Report dated Dec. 12, 2017", 11 pgs.

* cited by examiner
† cited by third party

AUTOMATIC LAPLESS BUTT MATERIAL SPLICE

RELATED APPLICATIONS

This application is a continuation of U.S. application Ser. No. 15/269,290, filed Sep. 19, 2016, Issued as patent Ser. No. 10/457,512, issued on Oct. 29, 2019, which application is incorporated by reference herein in its entirety.

FIELD OF THE INVENTION

The present application is generally directed to converting and printing machinery. Particularly, the present application relates to devices and systems for splicing rolls or webs of material. More particularly, the present application relates to devices and systems for creating a lapless butt material splice.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Converting and printing machinery may include winders and un winders. In a winder, an incoming web of material is wound onto a roll until the roll is filled. In an unwinder, a roll feeds an outgoing web of material. During unwinding, when a feeding roll is depleted or near depletion, a filled roll may replace the depleted roll and continue feeding the outgoing web material. Filled rolls of web material, such as for example newsprint, are typically large and heavy, weighing as much as several tons. Difficulties can arise with the transfer of the feeding source from one roll to the next.

It is common to splice the trailing edge of the depleted roll of material to the leading edge of the next roll of material to allow for generally continuous operation of the converting process. This splicing can be performed in various ways. A basic splicing technique involves stopping the converting machine or equipment, replacing the expired roll of material with a new roll of material, attaching the leading edge of the new roll of material to a trailing edge of the previous run roll of material, and restarting the machine. However, stopping and starting the machine can lead to excessive lost production time and other issues.

Other splicing methods aim to avoid stopping production. For example, an accumulator, festoon, or J-box may be arranged between the feeding roll and the remainder of the converting machine or equipment, such that material passes through the accumulator, festoon, or J-box. The accumulator, festoon, or J-box may have a plurality of rollers about which the material is passed before being fed to the remainder of the converting machine or equipment. The accumulator, festoon, or J-box is used to feed the converting machine or equipment while the feeding roll is stopped independent of the remainder of the converting machine or equipment, changed, and the material spliced. This method has various drawbacks, however. For example, the use of an accumulator, festoon, or J-box may require additional space, may increase the number of rollers that the web material contacts, which can lead to damage or wear of the material, and the material may be difficult to control within the accumulator, festoon, or J-box. Moreover, this method may be impractical for some higher speed processes, due to the size of accumulator, festoon, or J-box needed to continue supplying material at production speed while the feeding roll is changed.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a web splicer for on-the-fly splicing of an outgoing web with a replacement web arranged about a replacement roll and having a leading edge. The web splicer may have a cutting blade configured to cut the outgoing web to create a trailing edge. The web splicer may further have a bump roller rotatable about a central axis and configured to rotate in communication with the outgoing web. The bump roller may be arranged proximate to the replacement roll and may be further configured to press the trailing edge of the outgoing web against a first adhesive surface coupled to the replacement web. The web splicer may also have a splicer backup roller rotatable about a central axis and configured to rotate in communication with the outgoing web. The web splicer may have a splicer roller rotatable about a central axis, arranged proximate to the splicer backup roller, and configured to receive a second adhesive surface. The splicer roller may additionally be configured to selectively press the second adhesive surface against the leading edge of the replacement web and the trailing edge of the outgoing web. In some embodiments, the web splicer may have a motor communicably coupled to the splicer roller and configured to accelerate the splicer roller to a speed matching the speed of the outgoing web moving across the splicer backup roller. The web splicer may further have a pneumatic cylinder or motor, the pneumatic cylinder or motor configured to actuate movement of the cutting blade toward the outgoing web. The splicer may have another pneumatic cylinder or motor, the pneumatic cylinder or motor configured to actuate movement of the splicer roller and/or splicer backup roller to bring the splicer roller and splicer backup roller proximate to one another to press the second adhesive surface against the leading edge of the replacement web and the trailing edge of the outgoing web. In some embodiments, the web splicer may have a device for tracking the leading edge of the replacement roll. The device may be a leading edge marker arranged on the replacement roll and having a known relationship to the leading edge in some embodiments. The splicer may additionally have a device for tracking the location of the second adhesive strip in some embodiments. In some embodiments, the web splicer may be configured to form a lapless splice between the outgoing web and replacement web. Further, in some embodiments, the web splicer may be configured to transition from a first configuration, with the replacement roll in a first position, to a second configuration, with the replacement roll in a second position.

The present disclosure, in one or more embodiments, additionally relates to a method for splicing a replacement web with an outgoing web on the fly. The method may include accelerating rotation of the replacement roll to match a speed of the outgoing web, the replacement roll having a first adhesive strip affixed to an inner surface of a leading edge of the replacement web, such that a portion of the first adhesive strip remains exposed. The method may further include arranging a second adhesive strip on a splicer roller, the splicer roller rotatable about a central axis. The method may include cutting the outgoing web to form a trailing edge, wherein cutting the outgoing web causes the trailing edge to contact the exposed portion of the first adhesive strip. Additionally, the method may include pressing the trailing edge onto the first adhesive strip, adjacent to the leading edge, and affixing the second adhesive strip over the trailing edge and the leading edge via the splicer roller. In some embodiments, pressing the trailing edge onto the first adhesive strip may include passing the trailing edge, leading edge, and adhesive strip together across a bump roller, wherein the bump roller applies pressure to a surface of the trailing edge. Affixing the second adhesive strip over the trailing edge and the leading edge via the splicer roller may include passing the trailing edge and leading edge across a splicer backup roller and actuating at least one of the splicer roller and the splicer backup roller to bring the splicer roller and splicer backup roller proximate to one another to press the second adhesive strip against the leading edge and trailing edge. In some embodiments, the method may result in a lapless splice between the outgoing web and the replacement web. Moreover, in some embodiments, affixing the second adhesive strip over the trailing edge and the leading edge via the splicer roller may include adjusting a rotational phase of the splicer roller so as to align the second adhesive strip with the first adhesive strip.

The present disclosure, in one or more embodiments, additionally relates to a system for splicing a replacement web with an outgoing web on the fly. The system may include a plurality of rollers facilitating movement of the outgoing web and replacement web, a cutting blade configured to cut a trailing edge of the outgoing web, a web speed sensor sensing the speed of the outgoing web as it moves through the plurality of rollers, a leading edge sensor sensing a location of a leading edge of the replacement web, a splicer sensor sensing a location of an adhesive strip, and a controller receiving data from the web speed sensor, leading edge sensor, and splicer sensor, the controller further receiving an initiate splice signal. In some embodiments, upon receiving the initiate splice signal, the controller may operate the plurality of rollers and cutting blade to form, using the first and second adhesive strips, a splice between the trailing edge of the outgoing web and the leading edge of the replacement web. In some embodiments, the splice may be a lapless splice. In some embodiments, the controller may send a splice roll drive signal to accelerate rotation of a splicer roller. The controller may adjust the speed of the splicer roller based on information received from the web speed sensor. The controller may additionally adjust the rotational phase of the splicer roller based on information received from the splicer sensor. Moreover, the controller may send a splice roll trigger signal to actuate movement of a splicer roller.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1A:
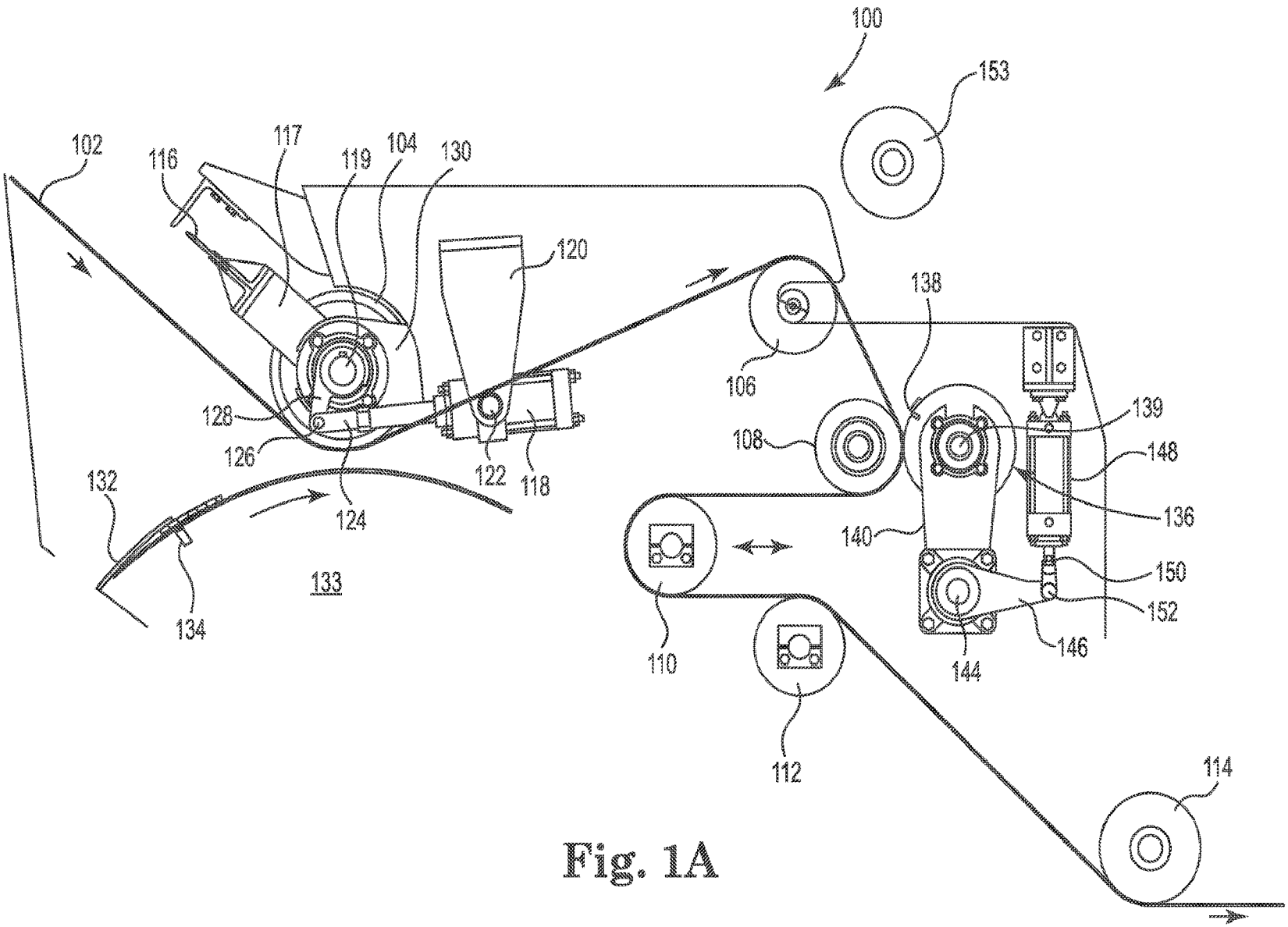
FIG. 1A is a schematic drawing of a splicer of the present disclosure in a first splicer configuration, according to one or more embodiments.

The present disclosure relates to devices, methods, and systems for splicing an outgoing roll of web material with a replacement roll of web material on the fly during unwinding in a converting or printing process.

The physical splice between a trailing edge of an outgoing web and a leading edge of a replacement web can be completed using various methods. In some methods, a double sided adhesive tape is used to join the two rolls, such that the tape is placed on a top surface of one edge and a bottom surface of another edge. This method is commonly referred to as a lap splice, and may be performed with stopped or moving machinery. However, the lap splice leads to a section of thickened web material where the two rolls overlap to join. The thickened section can lead to problems with the remainder of the converting machinery or equipment, such as for example where a coating is applied to the web material. Additionally, this method often leads to a free, uncontrolled span of web material, or "tail," between the adhesive tape and edge of the overlapping material. This tail can be problematic when passing through converting machinery or equipment.

Other methods for joining the depleted roll with the new roll involve a butt splice, wherein the end of the depleted roll and the leading edge of the new roll are abutted against one another and joined. The joining of the two edges may be done with an adhesive such as, for example, an adhesive tape applied to a top or bottom edge of the abutment. However, the formation of a butt splice can be difficult, requiring stopped machinery, or for moving machinery, a high degree of precision and accuracy. For example, the equipment needed to perform a butt splice without stopping production can involve expensive and highly sophisticated equipment. Furthermore, an improper butt splice can lead to a gap between the two edges of web material, leaving exposed adhesive, which may cause problems as the gap and exposed adhesive proceed through the remaining converting machinery or equipment.

In some embodiments, the present disclosure relates to devices, methods, and systems for splicing a trailing edge of an outgoing roll with a leading edge of a replacement roll with a lapless butt splice automatically and during production. For example, the leading edge of a replacement roll of web material may be prepared with an adhesive tape being placed partially under the leading edge, such that a portion of the adhesive tape remains exposed beyond the leading edge. The replacement roll may be accelerated to match the speed of the outgoing web's movement, a trailing edge of the outgoing web may be cut free from the outgoing roll, and the trailing edge of the outgoing roll may be positioned on the exposed portion of the adhesive tape. Further, in some embodiments, a second strip of adhesive tape may be applied over the exposed surface of the leading edge and trailing edge using, for example, a splicer roller timed to apply the tape when the edges pass proximate to the splicer roller. The devices, systems, and methods described herein may allow an outgoing roll of web material to be changed efficiently and automatically with minimal material loss and without stopping or slowing production. Moreover, the application of adhesive tape to both upper and lower surfaces of the web splice may provide for a more seamless transition between the two rolls of material and may mitigate issues that can arise when a splice encounters machinery or equipment further down the production line.

Figure 1B:
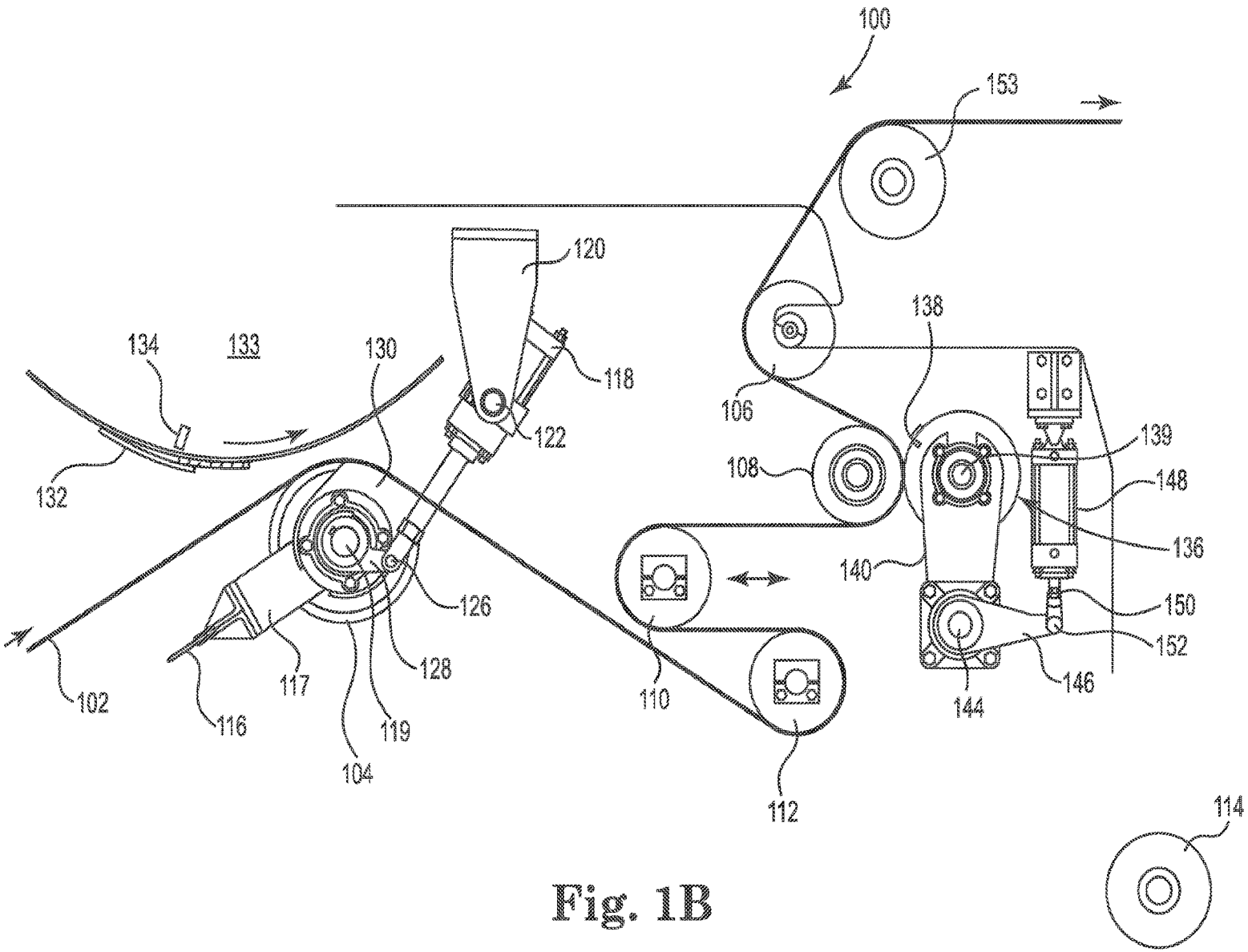
FIG. 1B is a schematic drawing of the splicer of FIG. 1 in a second splicer configuration, according to one or more embodiments.

Turning now to FIGS. 1A and 1B, a splicer 100 of the present disclosure is shown according to a first splicer configuration and second splicer configuration, respectively. The splicer 100 may have a plurality of rollers configured for directing a web 102. For example, in some embodiments, the splicer 100 may have a bump roller 104, an idle roller 106, a backup roller 108, idle rollers 110, 112, 114, and 153 and a splicer roll 136. In other embodiments, the splicer 100 may have different rollers and may have more or fewer rollers. The splicer 100 may additionally have a cutting blade 116 for cutting web material. The splicer 100 may generally be configured to splice the web 102, which may be an outgoing web, with a replacement web 132.

The outgoing web 102 may be any suitable web material, such as a paper, plastic, metal, textile, or other material. The outgoing web 102 may be disposed about a roll and fed through an unwinder converting machine or printing machine in some embodiments. The outgoing web 102 may move from the roll containing it, through the splicer 100, and into the converting or printing machine. The outgoing web 102 may generally be moved through the splicer and/or converting or printing machine by a series of motorized rollers. The outgoing web 102 may generally have a flattened shape with a thickness suitable for being fed through the splicer 100. At a trailing edge, the outgoing web 102 may be spliced with a leading edge of a replacement web 132 in order to continue the unwinding process. For example, in an unwinding process, when the roll containing outgoing web 102 is depleted or nearly depleted, a trailing edge of the outgoing web 102 may be spliced with a leading edge of the replacement web 132, such that the replacement web can continue feeding the unwinder. The replacement web 132 may generally be the same or a similar material as outgoing web 102.

The replacement web 132 may similarly be arranged about a roll, which may be a replacement roll 133. Generally, the replacement roll 133 may be configured to continue feeding web material through the splicer 100 and converting or printing machine after the leading edge of the replacement web 132 is spliced with the outgoing web 102. In this way, the unwinding operation may continue substantially uninterrupted while the web source is changed from the outgoing roll to replacement roll 133. The replacement roll 133 may be arranged on a rotating roller in some embodiments, or may otherwise be configured to rotate about a central axis. In some embodiments, the roller on which the replacement roll 133 is arranged may be driven by a motor, such that the replacement roll may rotate independent of other rollers within the splicer 100. In some embodiments, the replacement roll 133 may have a leading edge marker 134. The leading edge marker 134 may be arranged on the replacement roll 133 to mark a known relationship with the leading edge of the replacement web 132. The leading edge marker 134 may be affixed to an element that rotates with the replacement roll 133, such as a shaft or chuck for example. The leading edge marker 134 may be arranged at or near the perimeter of replacement roll 133, as shown for example in FIGS. 1A and 1B, in some embodiments. In other embodiments, the leading edge marker 134 may be arranged at a different location. The leading edge marker 134 may generally be part of or otherwise communicate with a sensing system. The sensing system may sense passage of or a location of the leading edge marker 134 while the replacement roll 133 is rotating, for example. In some embodiments, the leading edge marker 134 may include a retroreflective stripe, the passage of which may be sensed by an electro-optical sensor. In other embodiments, the leading edge marker 134 may employ magnetic or radio sensing or other types of sensing systems. In other embodiments, alternate methods may be used to track the location of the leading edge of the replacement web 132.

As may be appreciated from FIGS. 1A and 1B, the splicer 100 may be configured to accommodate varied arrangement of the roll feeding the outgoing web 102 and/or of the replacement roll 133. For example, as shown in FIG. 1A, in some embodiments, the roll feeding the outgoing web 102 may be arranged generally above the bump roller 104 and cutting blade 116, such that the outgoing web 102 may pass across the bump roller at an upper location on the bump roller. As further shown in FIG. 1B, the splicer 100 may additionally or alternatively be configured to accommodate a roll feeding the outgoing web arranged generally below the bump roller 104 and cutting blade 116, such that the outgoing web 102 may pass across the bump roller at a lower location on the bump roller. Similarly, the splicer 100 may accommodate positioning of the replacement roll 133 generally below the feed of the outgoing web 102, as shown for example in FIG. 1A, and/or above the feed of the outgoing web, as shown for example in FIG. 1B. The splicer 100 may be configured to accommodate other outgoing web 102 and replacement roll 133 arrangements in other embodiments.

With continued reference to FIGS. 1A and 1B, in some embodiments, the web material, including outgoing web 102 and/or replacement web 132, may move around or across a bump roller 104. The bump roller 104 may rotate about a central axis and may generally guide movement of the web material. The bump roller 104 may be configured to continue its rotational movement proximate to the replacement roll 133, such that a trailing edge of the outgoing web 102 and/or leading edge of the replacement web 132 pass between the bump roller and replacement roll. In this way, the bump roller 104, by its location proximate to the replacement roll 133, may apply pressure to the trailing edge and/or leading edge in order to urge a bond between to an adhesive strip. In some embodiments, the bump roller 104 may be configured to move toward the replacement roll 133 at a desired time. The bump roller 104 may operably move using a bump roll arm 130 coupled to a pneumatic cylinder or motor (not shown), for example. In some embodiments, the bump roll arm 130 may move the bump roller 104 linearly toward the replacement roll 133. In other embodiments, the bump roller 104 may move using different mechanisms. In still other embodiments, the axis of rotation of the bump roller 104 may be configured to remain stationary. For example, the bump roller 104 may rotate continuously while proximate to the replacement roll 133, or the replacement roll or another mechanism may operably move the leading edge and trailing edge of the webs 132, 102 proximate to the bump roller. In some embodiments, the bump roller 104 may be configured to rotate in in either direction about its central axis so as to accommodate both the first and second splicer configurations, shown in FIGS. 1A and 1B, respectively.

In some embodiments, a cutting blade 116 may be coupled to the bump roller 104. The cutting blade 116 may be configured to cut the outgoing web 102 at a desired time. For example, when the roll containing outgoing web 102 is nearly depleted, or when it is otherwise time to transition to the replacement roll 133 having replacement web 132, the cutting blade 116 may operably cut the outgoing web 102 from its roll, forming a trailing edge that extends from the bump roller 104. The cutting blade 116 may include any suitable type of blade or cutting apparatus. The cutting blade 116 may be configured to move in some embodiments so as to move toward and cut the outgoing web 102. For example, the cutting blade 116 may rotate about the rotational axis of the bump roller 104 in some embodiments. Particularly, the cutting blade 116 may be coupled to a cutting blade arm 117, which may pivot about a pivot 119, which may be aligned with a central axis of rotation of the bump roller 104. A blade actuating arm 128 may be coupled to the cutting blade arm 117 at pivot 119 and may additionally be coupled via a pivot 126 to a piston rod 124 operated by a pneumatic cylinder 118. The pneumatic cylinder 118 may be coupled to a support 120 via a pivot 122. The pneumatic cylinder 118 may operate to pull or push the piston rod 124, which may in turn pull or push the blade actuating arm 128, which may in turn cause the cutting blade arm 117 and cutting blade 116 to rotate about pivot 119. The pneumatic cylinder 118 may be actuated at a desired time, in order to bring the cutting blade in contact with the outgoing web 102 to cut the outgoing web. In other embodiments, the cutting blade 116 may move using different mechanisms such as a motor and/or may be arranged at a different location within the splicer 100. In other embodiments, the cutting blade 116 may be mounted in a fixed position, with the web 102 being moved to contact the blade 116 at an appropriate time to cut the web 102.

With continued reference to FIGS. 1A and 1B, the web material, including outgoing web 102 and/or replacement web 132, may move around or across a splicer backup roller 108. The splicer backup roller 108 may rotate about an axis and may generally guide movement of the web 102/132. In some embodiments, the splicer backup roller 108 may be configured to rotate in in either direction about its central axis so as to accommodate both the first and second splicer configurations, shown in FIGS. 1A and 1B, respectively. The splicer backup roller 108 may be configured to position the trailing edge of outgoing web 102 and leading edge of replacement web 132 to receive an adhesive strip, and may act as a back support when the adhesive strip is applied to the leading edge and trailing edge. The axis of rotation of the splicer backup roller 108 may generally be stationary.

In some embodiments, the splicer 100 may have a splicer roller 136. The splicer roller 136 may rotate about a central axis and, in some embodiments, may be driven by a motor through its shaft 139, such that the splicer roller may rotate independent of other rollers within the splicer 100. In some embodiments, the splicer roller 136 may be configured to rotate in either direction about its central axis so as to accommodate both the first and second splicer configurations, shown in FIGS. 1A and 1B, respectively. The splicer roller 136 may be configured to hold an adhesive material, such as an adhesive tape or strip that may be used to couple the two webs 102, 132. The adhesive strip may have an adhesive side intended to make contact with the webs 102, 132 and a non-adhesive side, which may be held against the splicer roller 136 until the adhesive strip is positioned over the webs. For example, the non-adhesive side of the adhesive strip may be affixed to the splicer roller 136 via tear tabs, which may be small pieces of tape configured to tear when the adhesive strip contacts webs 102, 132, releasing the adhesive strip from the splicer roller 136, spaced along the length of the strip. Additionally or alternatively, the splicer roller 136 may employ a vacuum suction to hold the non-adhesive side of the adhesive strip against the roller. In other embodiments, other mechanisms may be used to hold the adhesive strip on the splicer roller 136 before coupling it to the webs 102, 132. In still other embodiments, the splicer roller 136 may be fitted with a different type of adhesive, coupling material, or coupling mechanism for coupling the two webs 102, 132 together.

In addition to the rotation of the splicer roller 136 about an axis, the splicer roller 136 may be configured to move toward the splicer backup roller 108 so as to position the adhesive strip over the trailing edge of web 102 and leading edge of web 132, as the webs move across the splicer backup roller 108. For example, in some embodiments, the splicer roller 136 may be coupled to a splicer roller support arm 140 that may be configured to move rotationally in order to position the splicer roller 136 proximate to the splicer backup roller 108. For example, in some embodiments, the splicer roller support arm 140 may couple to a crank arm 146 via a pivot 144, which may in turn couple to piston rod 150 via a pivot 152. The piston rod 150 may in turn couple to a pneumatic cylinder 148. The pneumatic cylinder 148 may operate to push or pull piston rod 150, which may in turn push or pull crank arm 146, which may in turn cause splicer roller support arm 140 and splicer roller 136 to rotate about pivot 144 to move toward the splicer backup roller 108. The pneumatic cylinder 148 may be actuated at a desired time in order to bring the adhesive strip on the splicer roller 136 proximate to the splicer backup roller 108 when the leading edge and trailing edge pass over the splicer backup roller. In other embodiments, other mechanisms such as a motor, may be used to position the splicer roller 136 proximate to the splicer backup roller 108 or otherwise proximate to the webs 102, 132. In still other embodiments, the axis of rotation of the splicer roller 136 may be configured to remain stationary and the splicer backup roller 108, for example, may operably move toward the splicer roller 136 to position the trailing edge of web 102 and leading edge of web 132 proximate to the splicer roller so as to position the webs against the adhesive strip.

In some embodiments, the splicer roller 136 may have a splicer marker 138 for determining the location of the adhesive strip. The splicer marker 138 may be arranged on the splicer roller 136 to mark a known relationship with the adhesive strip arranged on the roller. The splicer marker 138 may be affixed to an element that rotates with the splicer roller 136. The splicer marker 138 may be arranged at or near the perimeter of splicer roller 136, as shown for example in FIGS. 1A and 1B, in some embodiments. In other embodiments, the splicer marker 138 may be arranged at a different location. The splicer marker 138 may be a temporary or permanent marker. For example, a permanent marker may indicate where an adhesive strip should be placed on the splicer roller 136, or a temporary marker may be arranged on the splicer after the adhesive strip is positioned. In some embodiments, the splicer marker 138 may be part of or otherwise communicate with a sensing system, similar to the leading edge marker 134 discussed above. Generally, the sensing system may sense passage of or a location of the splicer marker 138 while the splicer roller 136 is rotating. In some embodiments, the sensing system may employ an absolute encoder.

With continued reference to FIGS. 1A and 1B, in some embodiments, the splicer 100 may have one or more idle rollers. Each idle roller may be configured to rotate about a central axis and may generally guide movement and direction of the web 102, 132 through the splicer 100. In some embodiments, the idle rollers may be configured to rotate in in either direction about their central axes so as to accommodate both the first and second splicer configurations, shown in FIGS. 1A and 1B, respectively. An idle roller may generally be a mechanical roller rotating with movement of the web 102, 132. As shown in FIGS. 1A and 1B, in some embodiments, the splicer 100 may have idle rollers 106, 110, 112, 114, and 153. One or more of the idle rollers may be arranged between the bump roller 104 and splicer backup roller 108. Additionally or alternatively, one or more of the idle rollers may be arranged between the splicer backup roller 108 and the point at which the web material 102/132 exits the splicer 100. In other embodiments, the splicer 100 may have more, fewer, or alternative rollers to those shown in FIGS. 1A and 1B. In the first configuration shown in FIG. 1A, the web material 102/132 may follow a progression through the splicer 100 from the bump roller 104 to idle roller 106, splicer backup roller 108, and idle rollers 110, 112, and 114 before exiting the splicer. In the second configuration shown in FIG. 1B, the web material 102/132 may follow a progression through the splicer 100 from the bump roller 104 to idle rollers 112 and 110, splicer backup roller 108, and idle rollers 106 and 153 before exiting the splicer. In other embodiments, the web 102/132 may move across the various rollers of the splicer 100 in a different configuration.

In some embodiments, the splicer 100 may be configured to transition between the first splicer configuration shown in FIG. 1A and the second splicer configuration shown in FIG. 1B. The transition between configurations may be performed automatically, partially automatically, or manually. To transition from the first configuration to the second configuration, the pneumatic cylinder 118 may pivot at its connection to the support 120 via pivot 122, so as to rotate the bump roller 104 and cutting blade 116 assemblies to their positions in the second configuration, as shown in FIG. 1B. For example, the pneumatic cylinder 118 may pivot generally downward in some embodiments such that the replacement roll 133 may be arranged above the bump roller 104 and cutting blade 116. Further, the cutting blade arm 117, blade actuating arm 128, and piston rod 124 may each pivot about pivot 119 so as to reposition the cutting blade and reconfigure the cutting blade operation. That is, for example, in the second configuration shown in FIG. 1B, the cutting blade arm 117, blade actuating arm 128, and piston rod 124 may be configured to rotate in a different direction than in the first configuration, such that the cutting blade 116 may be directed to cut the outgoing web 102 from the repositioned outgoing roll.

In use, the splicer 100 may operate to splice the trailing edge of outgoing web 102 with the leading edge of replacement web 132, such that replacement web 132 may continue to feed the converting equipment or printer after the splice. The splicer 100 may generally operate in conjunction with the unwinder, such that the web from the unwinder passes through the splicer 100.

Figure 2:
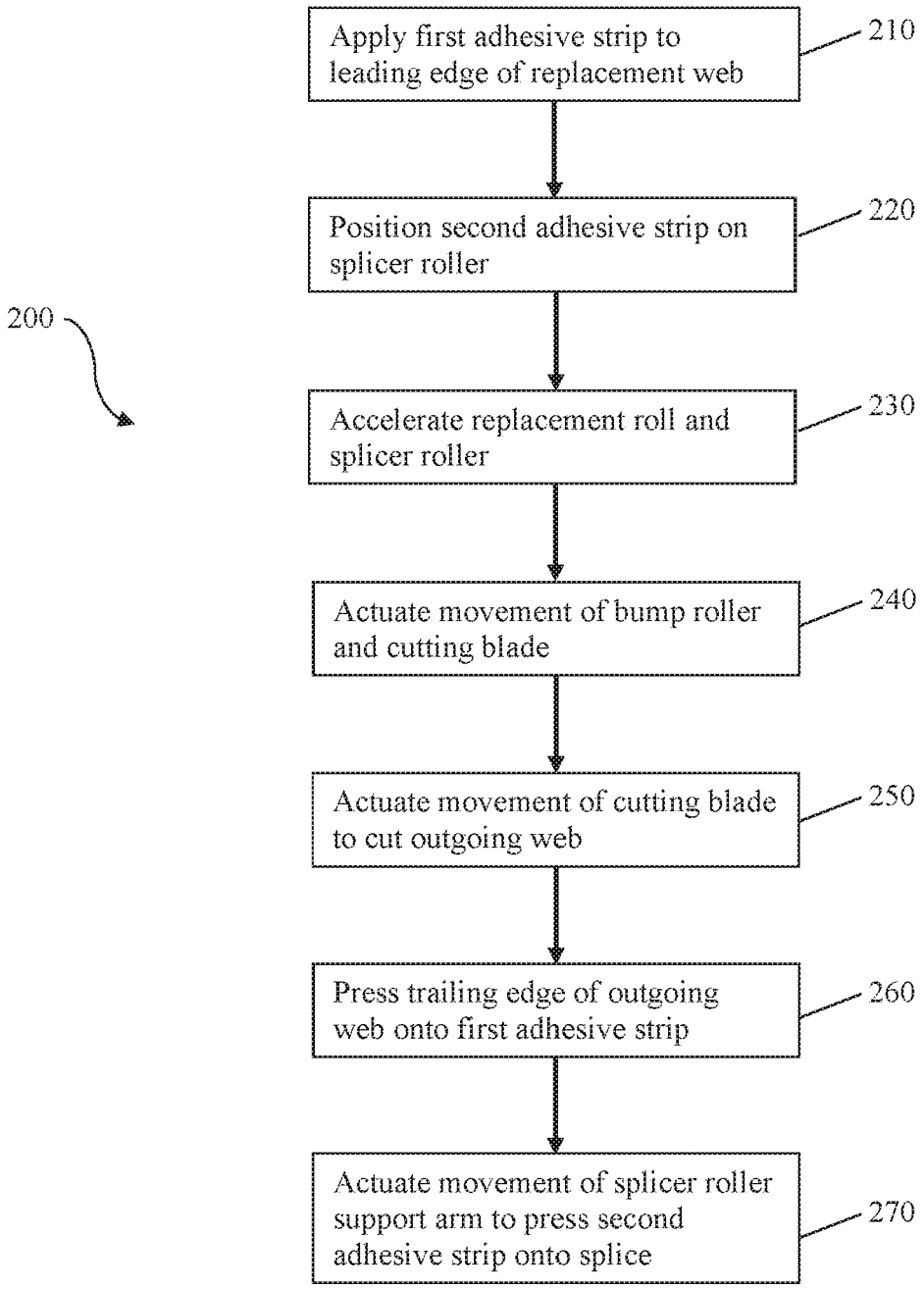
FIG. 2 is a flow diagram of a method of the present disclosure, according to one or more embodiments.

Turning now to FIG. 2, a method 200 of splicing a replacement web with an outgoing web is shown. As shown in FIG. 2, the method 200 may include the steps of applying a first adhesive strip to the leading edge of a replacement web (210); positioning a second adhesive strip on the splicer roll (220); accelerating the replacement roll and splicer roller (230); actuating movement of the bump roller and cutting blade (240); actuating movement of the cutting blade to cut the outgoing web (250); pressing the trailing edge of the outgoing web onto the first adhesive strip (260); and actuating movement of the splicer roller support arm to press the second adhesive strip onto the splice (270). The method 200 may be completed using the splicer 100 in the first configuration shown in FIG. 1A, the second configuration shown in FIG. 1B, and/or any other suitable configuration.

Figure 3A:
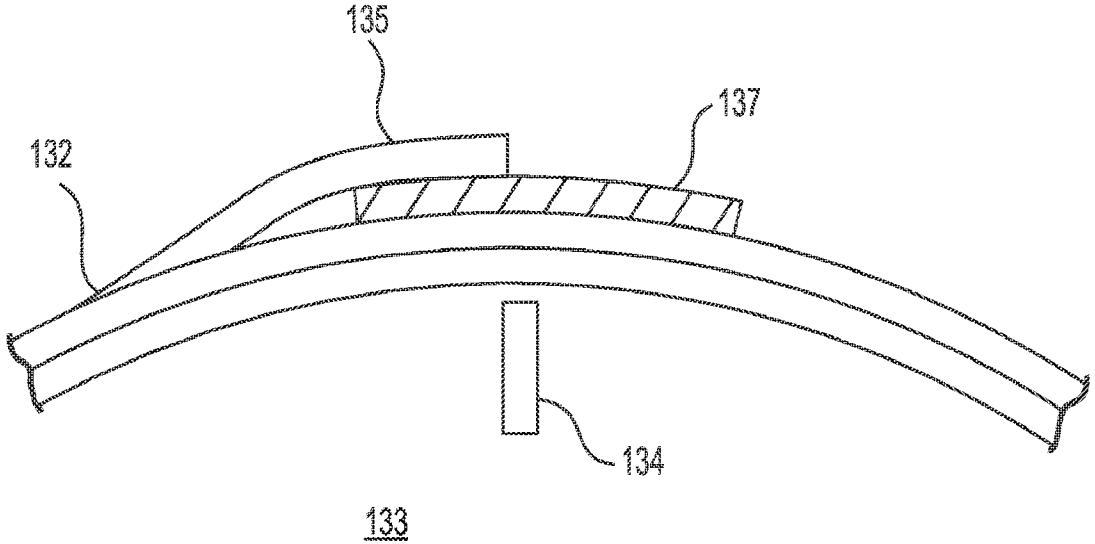
FIG. 3A is a close up view of a leading edge of a replacement web of the present disclosure in the first splicer configuration, according to one or more embodiments.
Figure 3B:
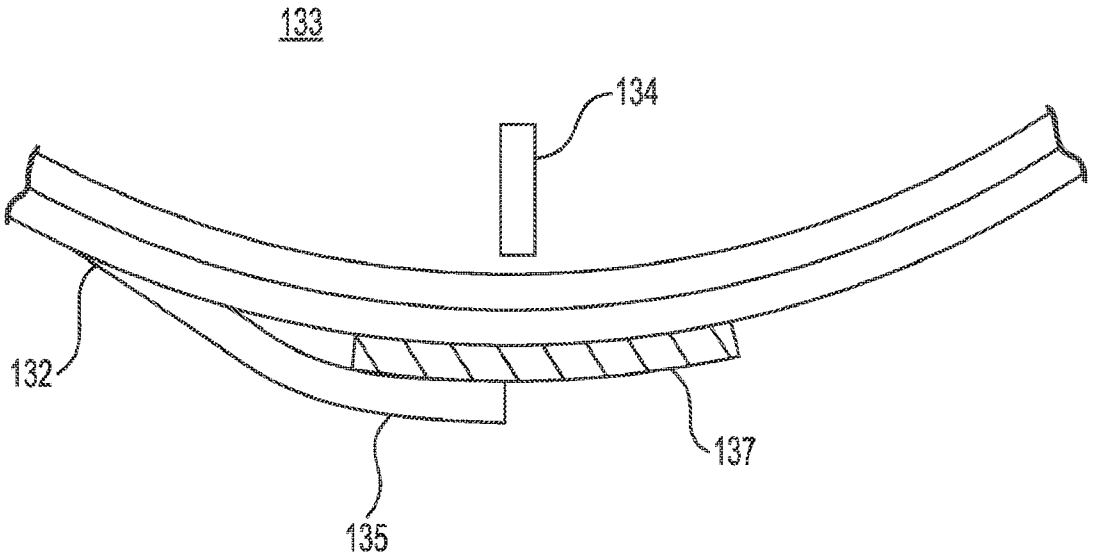
FIG. 3B is a close up view of a leading edge of a replacement web of the present disclosure in the second splicer configuration, according to one or more embodiments.

As shown in FIG. 2, the method 200 of splicing a replacement web with an outgoing web may include applying a first adhesive strip to the leading edge of a replacement web (210). FIGS. 3A and 3B show the replacement web 132 having a leading edge 135 and arranged on a replacement roll 133 with respect to the first and second configurations of the splicer 100, respectively. FIGS. 3A and 3B each further show replacement marker 134, as described above. The leading edge 135 may be trimmed or otherwise configured to align with the leading edge marker 134. Other methods, as described above, may be used to track the location of the leading edge 135 in some embodiments. In some embodiments, a first adhesive strip 137 may be arranged generally beneath the leading edge 135 of the replacement web 132. For example, the first adhesive strip 137 may have an adhesive side and a non-adhesive side. A bottom or roll-side surface of the leading edge 135 may be arranged on and/or pressed against the adhesive side of the first adhesive strip 137, such that the non-adhesive side of the strip may be arranged over a top surface of a next layer of web material on the replacement roll 133. In some embodiments, tear tabs or other mechanisms may be used to hold the non-adhesive side of the strip 137 against the top surface of the next layer of web material on the replacement roll 133. The leading edge 135 may be arranged on the first adhesive strip 137 such that a portion of the adhesive strip remains exposed, extending beyond the leading edge. As shown in FIGS. 3A and 3B, a portion of the adhesive side of the strip 137 may remain exposed and facing outward, away from the roll 133, so as to receive a trailing edge of the outgoing web 102, for example. The adhesive strip 137 may generally have any size and shape suitable to couple to both web edges. It may be appreciated that in other embodiments, the leading edge 135 may be treated with a different adhesive or coupling mechanism, such as an adhesive glue for example.

Figure 4A:
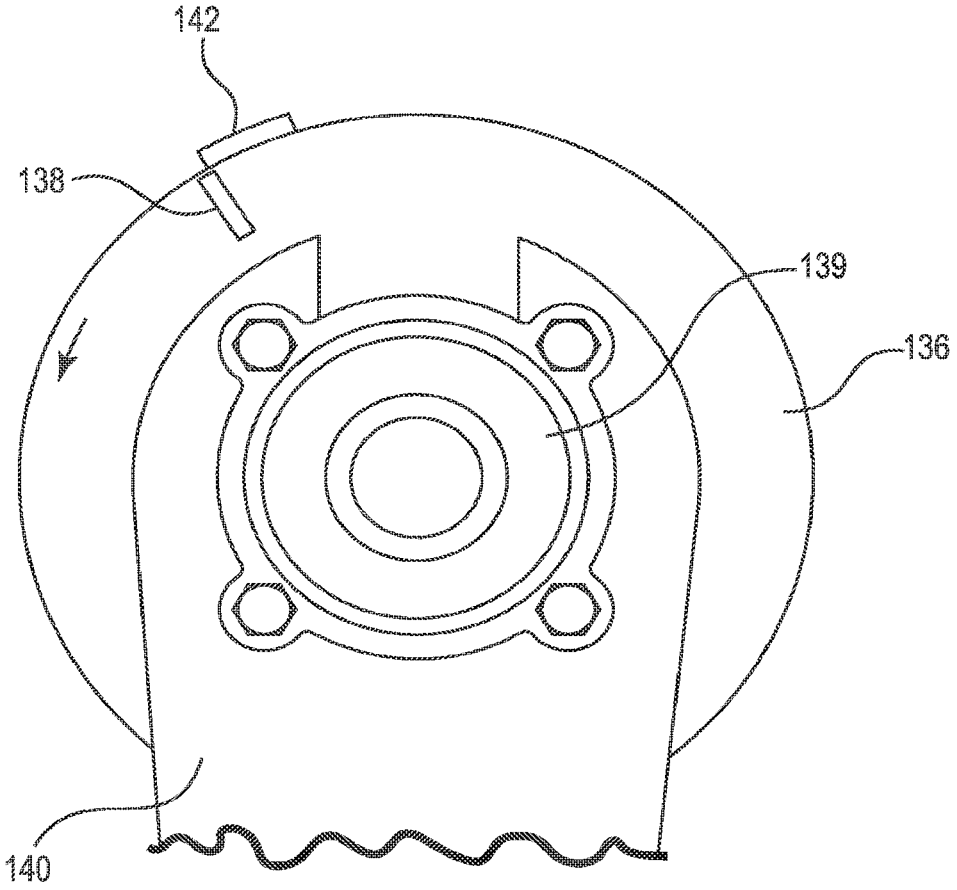
FIG. 4A is a close up view of a splicer roller of the present disclosure in the first splicer configuration, according to one or more embodiments.
Figure 4B:
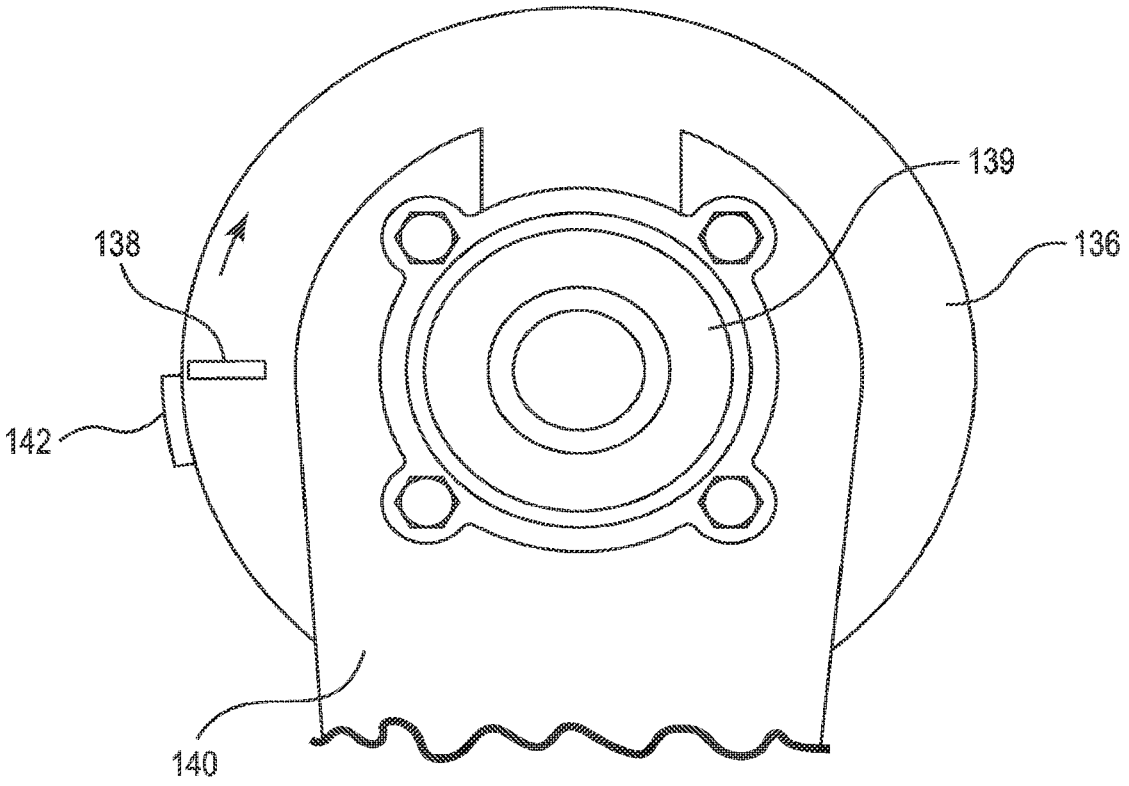
FIG. 4B is a close up view of a splicer roller of the present disclosure in the second splicer configuration, according to one or more embodiments.

With reference back to FIG. 2, the method 200 may include positioning a second adhesive strip on the splicer roller (220). FIGS. 4A and 4B show the splicer roller 136 and second adhesive strip 142 with respect to the first and second configurations of the splicer 100, respectively. As shown in FIGS. 4A and 4B, the splicer roller 136 may be held in place by a bearing 139 mounted on splicer roll arm 140 and may be independently rotated by a motor. As described above, the splicer roller 136 may have a splicer marker 138 or other mechanism to track the location of the second adhesive strip. A second adhesive strip 142 may be arranged on the splicer roller 136. The second adhesive strip 142 may have an adhesive side, which may face outward, away from the roller 136, and a non-adhesive side, which may be arranged on the roller. As described above, tear tabs, a vacuum mechanism, and/or other mechanisms may be employed to hold the non-adhesive side of the adhesive strip 142 against the splicer roller 136. The second adhesive strip 142 may be arranged on the splicer roller 136 such that an edge of the adhesive strip aligns with the splicer marker 138. As shown in FIGS. 4A and 4B, the adhesive strip 142 and/or splicer marker 138 may be arranged differently based on the direction that the splicer roller 136 is configured to rotate to apply the adhesive strip. For example, the splicer marker 138 may be positioned to mark a leading edge of the adhesive strip 142 in some embodiments, which may depend on the direction of rotation of the splicer roller 136.

With reference back to FIG. 2, the method 200 may include accelerating the replacement roll and splicer roller (230). As described above, the replacement roll 133 having replacement web 132 may be arranged on a roller capable of rotating about a central axis, and which may be actuated by a motor. When the roll having outgoing web 102 nears depletion, or when it is otherwise nearly time to splice the two webs 102, 132, the roller having replacement roll 133 may be accelerated, causing the replacement roll to rotate. The replacement roll 133 may be accelerated in a direction of rotation generally opposing the direction of rotation of the bump roller 104. For example, where the bump roller 104 is configured to rotate clockwise, the replacement roll 133 may be configured to rotate counter-clockwise in some embodiments. The acceleration of the replacement roll 133 may be initiated automatically or by a user input. The replacement roll 133 may be accelerated to a peripheral speed matching the speed of web 102's movement through the splicer 100. Similarly, the splicer roller 136 may be rotated about its central axis. The splicer roller 136 may be accelerated to a peripheral speed matching the speed of web 102's movement through the splicer 100. The splicer roller 136 may be accelerated in a direction of rotation generally opposing the direction of rotation of the splicer backup roller 108. For example, where the splicer backup roller 108 is configured to rotate clockwise, the splicer roller 136 may be configured to rotate counter-clockwise in some embodiments. In some embodiments, the replacement roll 133 and splicer roller 136 may be accelerated simultaneously. In other embodiments, where for example it takes a greater amount of time for the web 102 to move through the splicer 100, the replacement roll 133 and splicer roller 136 may be accelerated consecutively. Using sensed leading edge marker 134 and splicer marker 138, the rotational phases of the replacement roll 133 and splicer roller 136 may be coordinated to facilitate the timing of the splice.

Figure 5A:
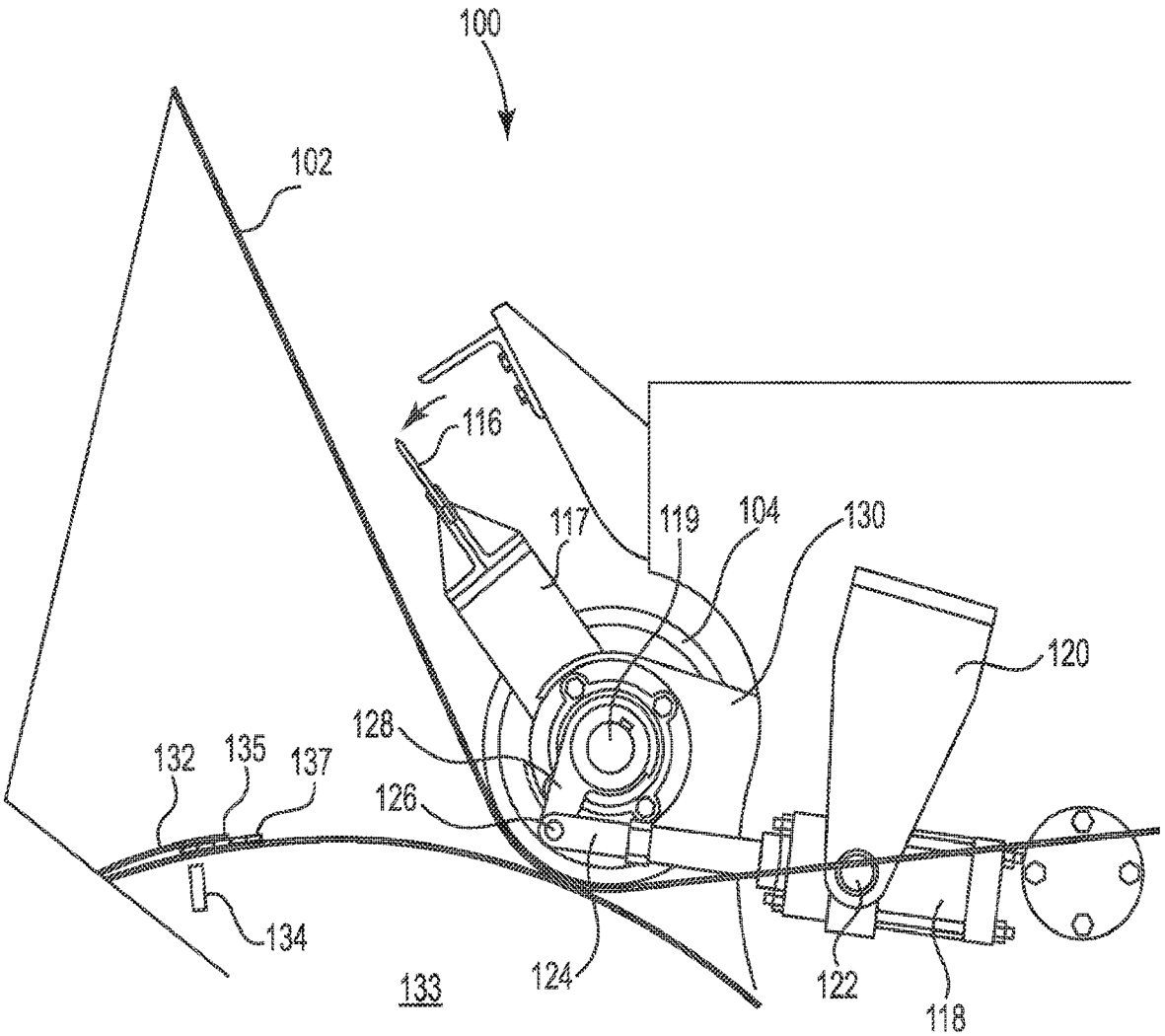
FIG. 5A is a close up view of a bump roller and cutting blade of the present disclosure during a splicing operation and in the first splicer configuration, according to one or more embodiments.
Figure 5B:
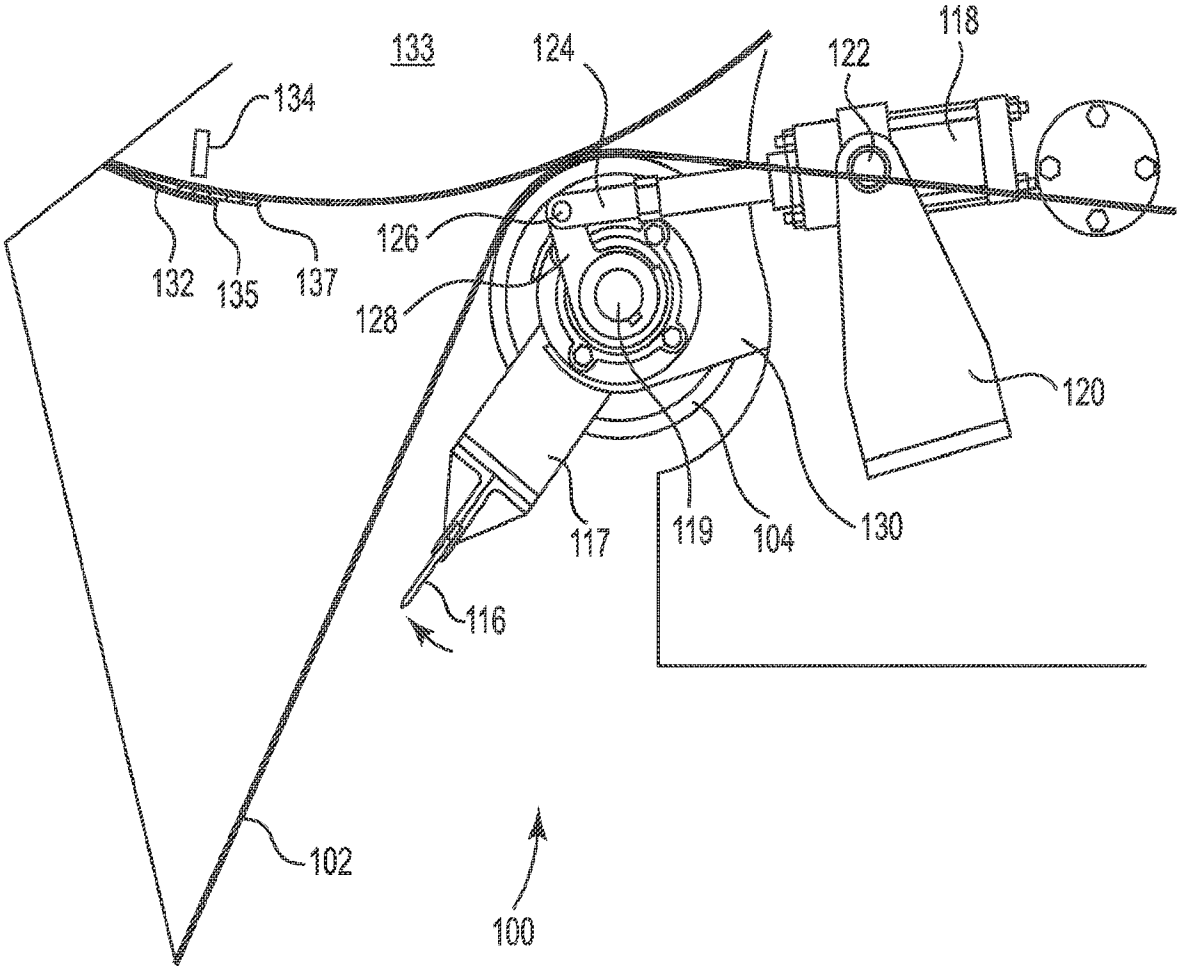
FIG. 5B is a close up view of a bump roller and cutting blade of the present disclosure during a splicing operation and in the second splicer configuration, according to one or more embodiments.

The method 200 may include actuating movement of the bump roller and cutting blade (240). Creation of the splice between the two webs 102, 132 may begin with actuation of the bump roller 104 and cutting blade 116. As shown in FIGS. 1A and 1B, the bump roller 104 and cutting blade 116 may be generally arranged at a distance from the replacement roll 133. When actuated, the bump roller 104 and cutting blade 116 may move linearly, or in some embodiments rotationally, toward the replacement roll 133, as seen in FIGS. 5A and 5B. FIGS. 5A and 5B show the bump roller 104 and cutting blade 116 actuation with respect to the first and second configurations of the splicer 100, respectively. As shown in FIGS. 5A and 5B, the bump roller 104 may move to a position proximate to the replacement roll 133, such that the web 102 passing across the bump roller 104 and the replacement web 132 arranged on replacement roll 133 may be in communication with one another. In other embodiments, the replacement roll 133 may be actuated to move toward the bump roller 104. In this position, the bump roller 104 and replacement roll 133 may each be capable of rotating about their respective central axes without interruption.

Figure 6A:
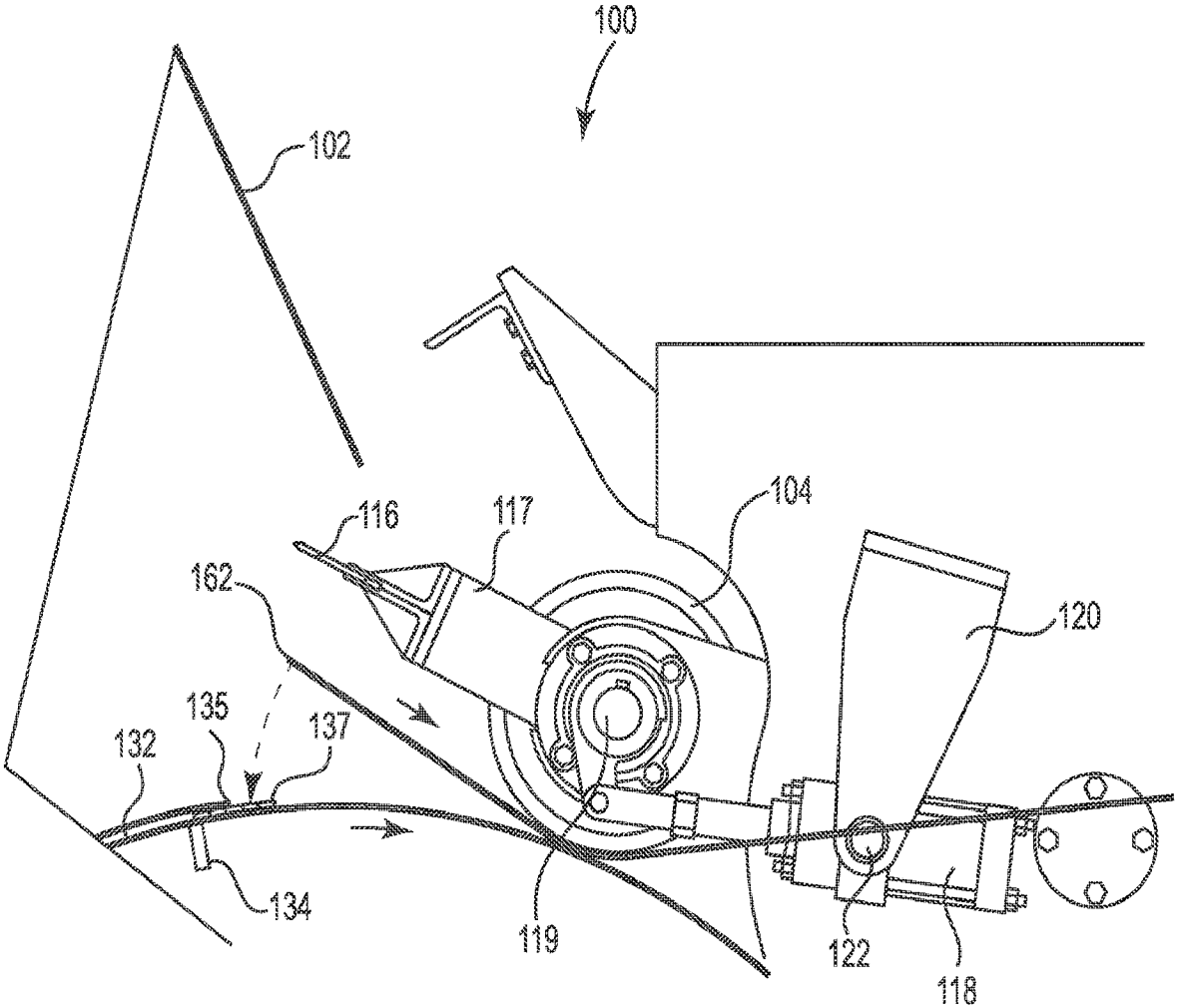
FIG. 6A is a close up view of a bump roller and cutting blade of the present disclosure after the cutting blade has cut the outgoing web and in the first splicer configuration, according to one or more embodiments.
Figure 6B:
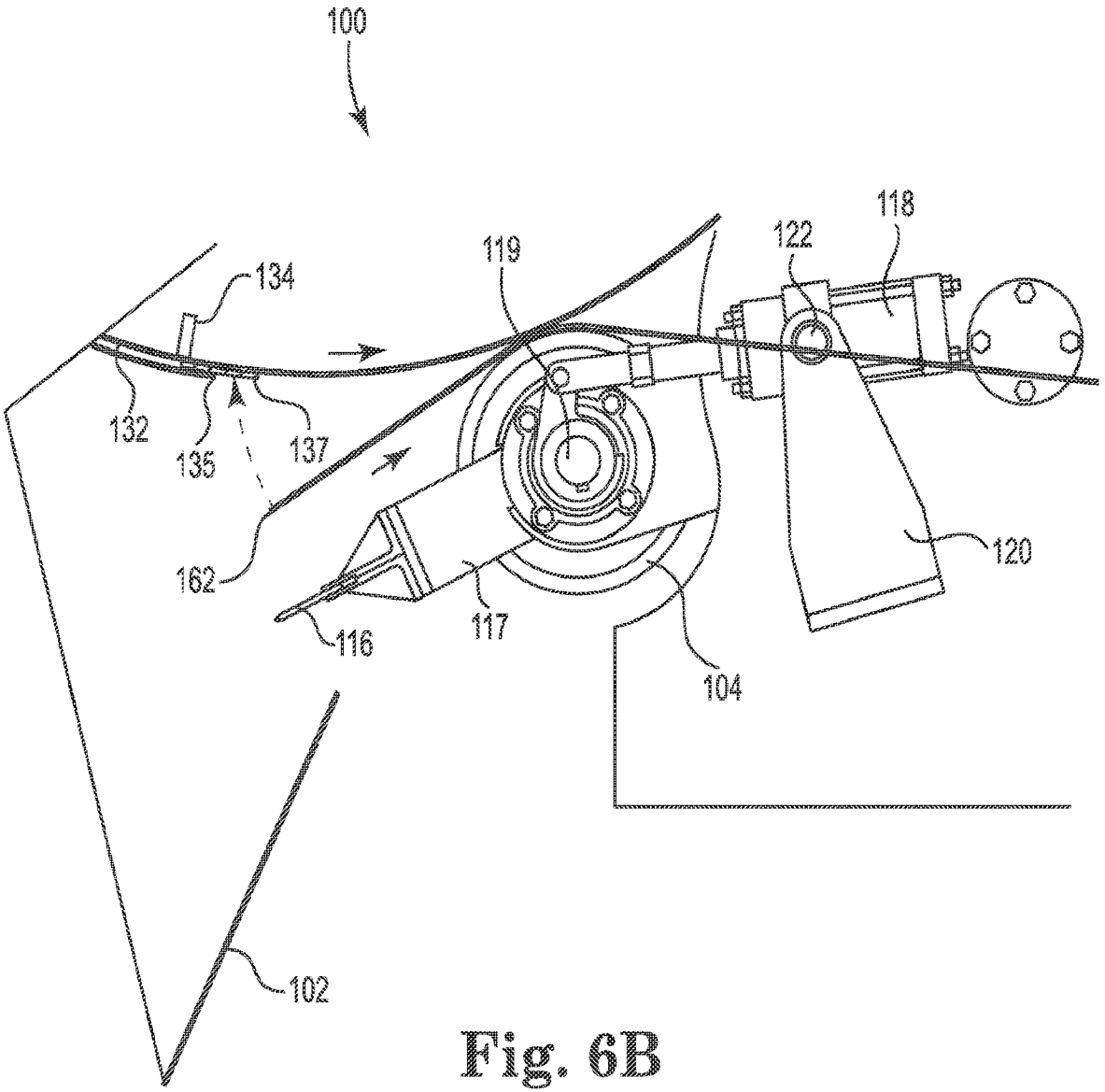
FIG. 6B is a close up view of a bump roller and cutting blade of the present disclosure after the cutting blade has cut the outgoing web and in the second splicer configuration, according to one or more embodiments.

With reference back to FIG. 2, simultaneous with or after step (240), the method 200 may include actuating movement of the cutting blade to cut the outgoing web (250). As described above, the cutting blade 116 and cutting blade arm 117 may rotate about pivot 119 by way of pneumatic cylinder 120. At a desired time, based for example on the sensed location of the rotating leading edge marker 134, the piston 120 may be actuated to rotate the cutting blade arm 117 about pivot 119 in order to bring the cutting blade 116 in contact with web 102. As shown in FIGS. 6A and 6B, the cutting blade 116 and cutting blade arm 117 may rotate toward the web 102. FIGS. 6A and 6B show the actuation of the cutting blade 116 with respect to the first configuration and second configuration of the splicer 100, respectively. As the cutting blade 116 makes contact with the web 102, a trailing edge 162 may be cut. The movement of cutting blade 116 may be timed such that after the trailing edge 162 is cut, the trailing edge may make contact with the exposed adhesive side of the first adhesive strip 137 by virtue of the continued movement rotation of the bump roller 104 and replacement roll 133, as shown in FIGS. 6A and 6B, forming partial splice 170'. In other embodiments, the web 102 may be moved toward a stationary cutting blade 116, and/or other mechanisms may be used to bring the cutting blade in contact with the web. The timing of the cut may relate to a sensed or otherwise determined location of the leading edge marker 134 or leading edge 135. For example, where the bump roller 104 and replacement roll 133 are proximate to one another at a contact point, the outgoing web 102 may be cut where the length of the outgoing web 102 between the contact point and cut location equals or is substantially similar to the length of replacement web 132 between the contact point and the leading edge marker 134 or leading edge 135. In other embodiments, the timing of the cut may incorporate or be based on different factors.

In some embodiments, the trailing edge 162 of outgoing web 102 may make contact with the first adhesive strip 137 such that a gap is formed between the trailing edge 162 and leading edge 135 of replacement web 132. That is, a portion of the adhesive surface of the first adhesive strip 137 may remain exposed between the trailing edge 162 and leading edge 135 in some embodiments. The gap formed between the two edges 162, 135 may be minimal in some embodiments, but generally may allow the two edges to be arranged in proximity on the first adhesive strip 137 without overlap of the edges. Overlap between the two spliced edges can cause problems further down the production or processing line, and allowing a small gap between the two edges may mitigate overlapping edges in a splice. In other embodiments, the timing may be configured such that the trailing edge 162 of outgoing web 102 makes contact with the first adhesive strip 137 so as to abut the leading edge 135 of replacement web 132.

With reference back to FIG. 2, the method 200 may include pressing the trailing edge of the outgoing web onto the first adhesive strip (260). As described above, the trailing edge 162 may contact the first adhesive strip 137 as a result of the cut of web 102, thus forming partial splice 170'. The continuous and synchronized rotation of the bump roller 104 and replacement roll 133 may bring the partial splice 170' to a position between the bump roller and replacement roll. When the partial splice 170' is between the replacement roll 133 and bump roller 104, the close proximity of the replacement roll and bump roller may cause the bump roller to press the trailing edge 162 of the outgoing web 102 and/or leading edge 135 of replacement web 132 onto the adhesive side of the first adhesive strip 137. That is, for example, while the trailing edge 162 of web 102 may have made contact with the adhesive side of the first adhesive strip 137 as a result of the cutting action and continued rotation of the bump roller 104 and replacement roll 133, the bump roller may operate to more firmly press the trailing edge onto the adhesive material so as to ensure a bond between the adhesive strip and the trailing edge.

Figure 7A:
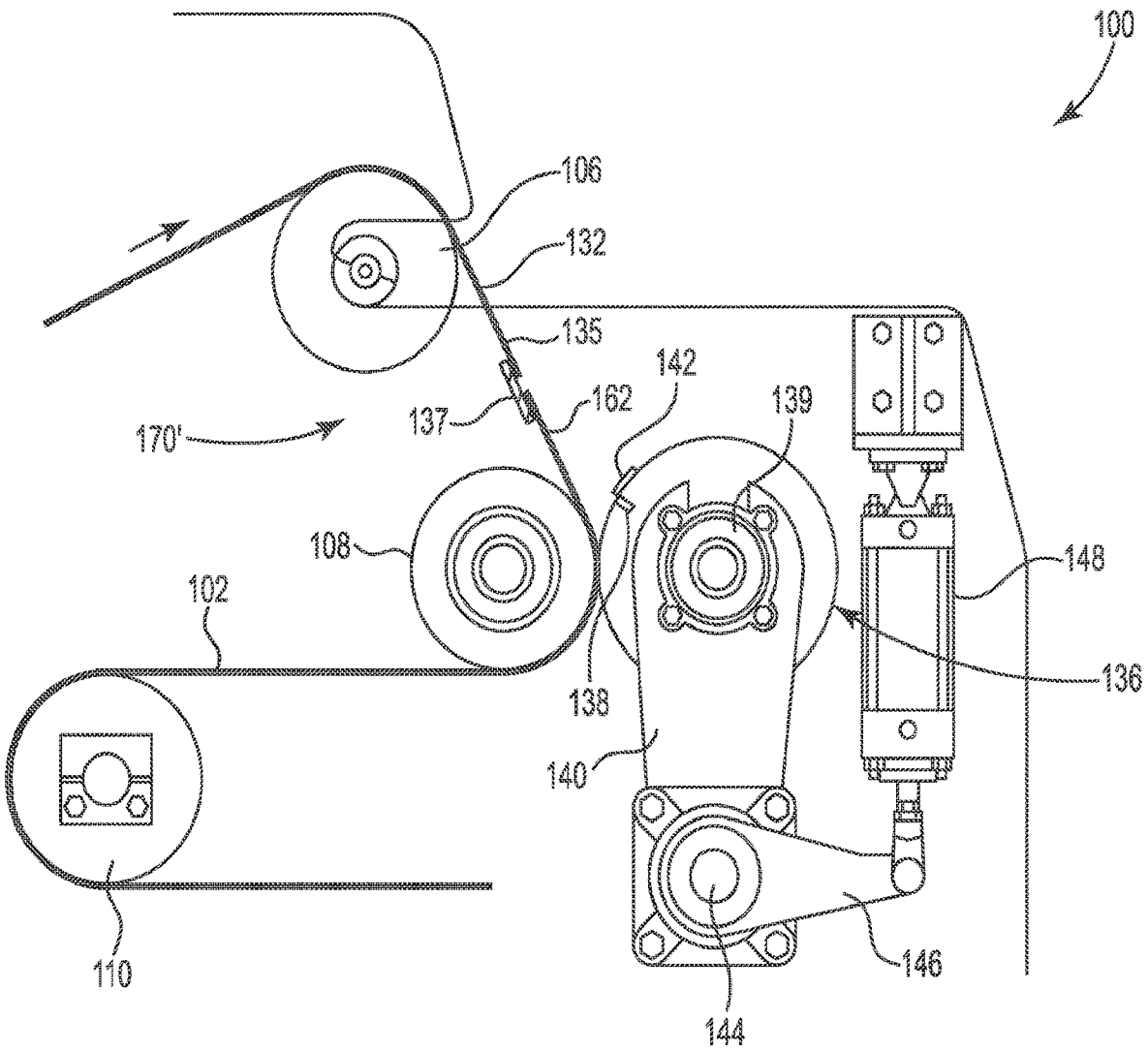
FIG. 7A is a close up view of a splicer roller of the present disclosure during a splicing operation and in the first splicer configuration, according to one or more embodiments.
Figure 7B:
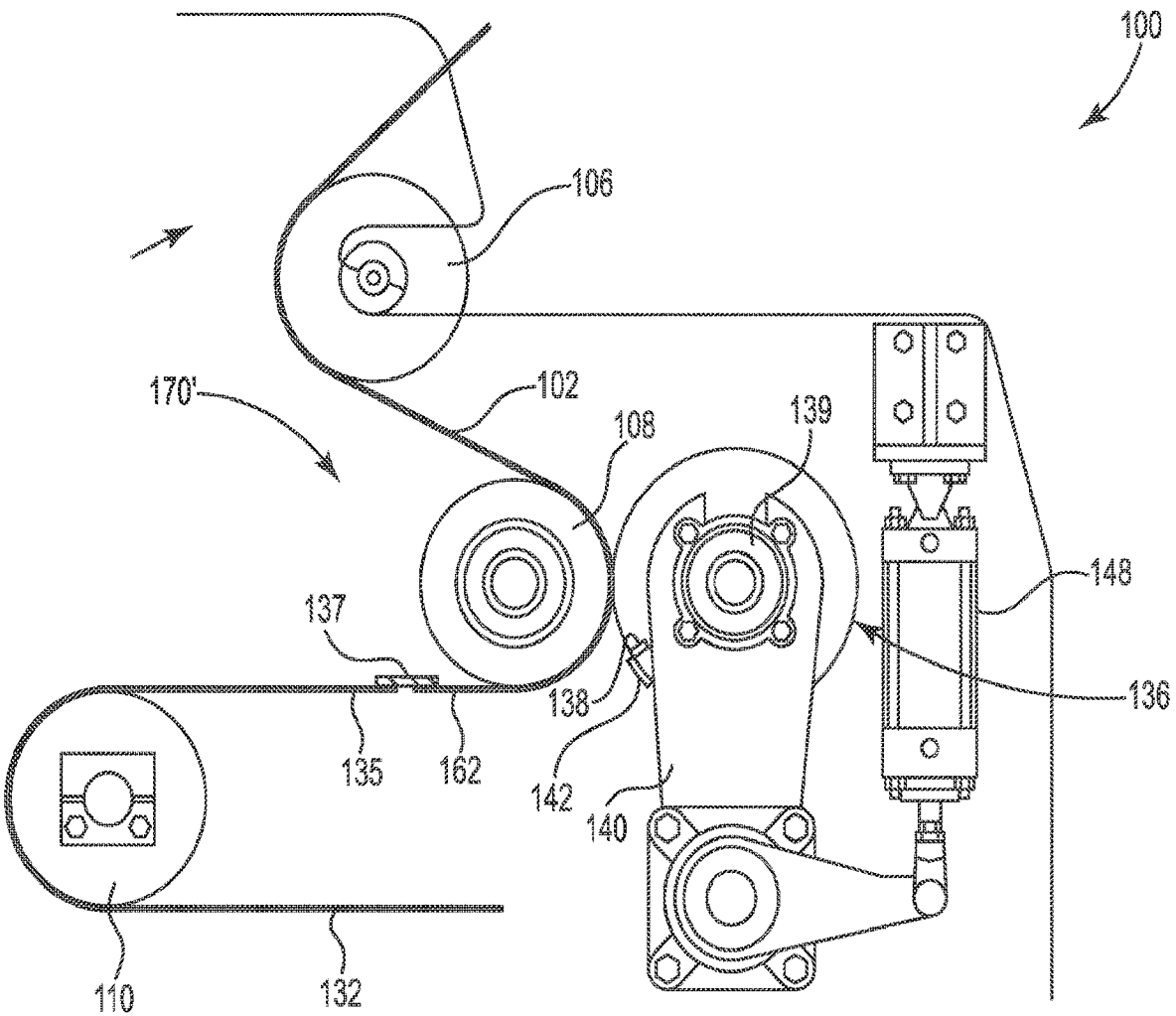
FIG. 7B is a close up view of a splicer roller of the present disclosure during a splicer operation and in the second splicer configuration, according to one or more embodiments.

With reference back to FIG. 2, the method 200 may include actuating movement of the splicer roller support arm to press the second adhesive strip onto the splice (270). As shown in FIGS. 1A and 1B, the splicer roller 136 and splicer roller support arm 140 may be generally arranged at a distance from the splicer backup roller 108. FIGS. 7A and 7B show actuation of the splicer roller support arm 140 with respect to the first and second configurations of the splicer 100, respectively. When the splicer roller support arm 140 is actuated, the splicer roller 136 and splicer roller support arm may move toward the splicer backup roller 108, as seen in FIGS. 7A and 7B. The splicer roller 136 and splicer roller support arm 140 may move linearly or rotationally in some embodiments. As shown in FIGS. 7A and 7B, the splicer roller 136 may move to a position proximate to the splicer backup roller 108, such that the web 102 passing across the splicer backup roller may additionally be in communication with the splicer roller. In this position, the splicer backup roller 108 and splicer roller 136 may each be capable of rotating about their respective central axes without interruption. The continuous and synchronized rotation of the splicer backup roller 108 and splicer roller 136 may bring the partial splice 170' to a position between the two rollers. The rotation of the splicer roller 136 may be timed, using the splicer marker 148 for example, such that when the partial splice 170' is between the two rollers 108, 136, the second adhesive strip 142 may also be arranged between the two rollers. The close proximity of the two rollers 108, 136 may cause the splicer roller 136 to press the second adhesive strip 142 onto the partial splice 170', bonding with the trailing edge 162, leading edge 135, and any exposed adhesive of the first adhesive strip 137. In some embodiments, the acceleration of the splicer roller 136 and/or the movement of the splicer roller arm 140 may be such that the second adhesive strip 142 may contact the partial splice 170' on a first rotation once in place proximate to the splicer backup roller 108. That is, the timing of the movement and/or acceleration of the splicer roller 136 may be such that the second adhesive strip 142 contacts the web 102, 132 at the point of the partial splice 170' and not before or after. The close proximity of the two rollers 108, 136 may generally serve to press the second adhesive strip 142 onto the partial splice 170', so as to form a sufficient bond, thus completing the splice 170.

Figure 8A:
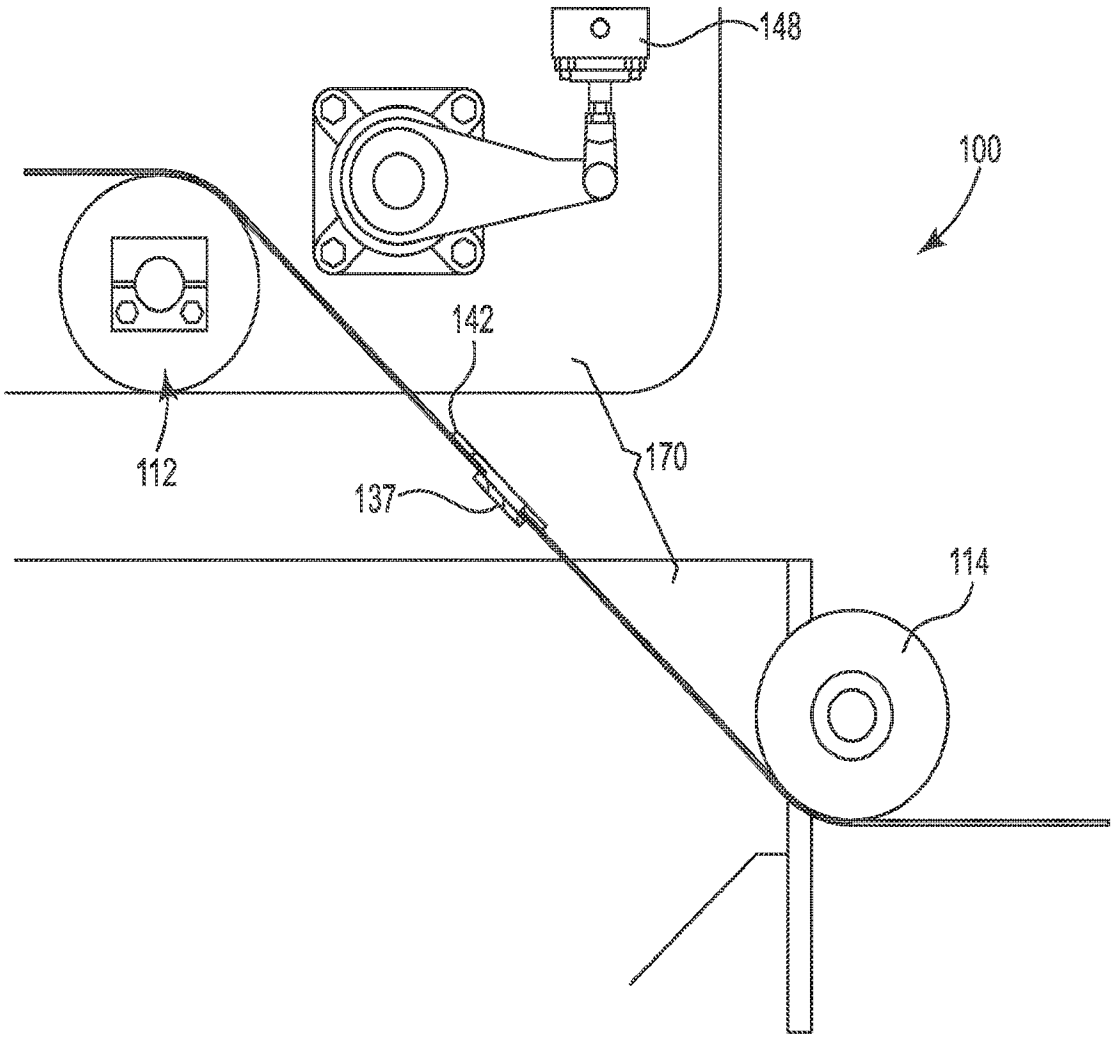
FIG. 8A is a close up view of a completed splice of the present disclosure in the first splicer configuration, according to one or more embodiments.
Figure 8B:
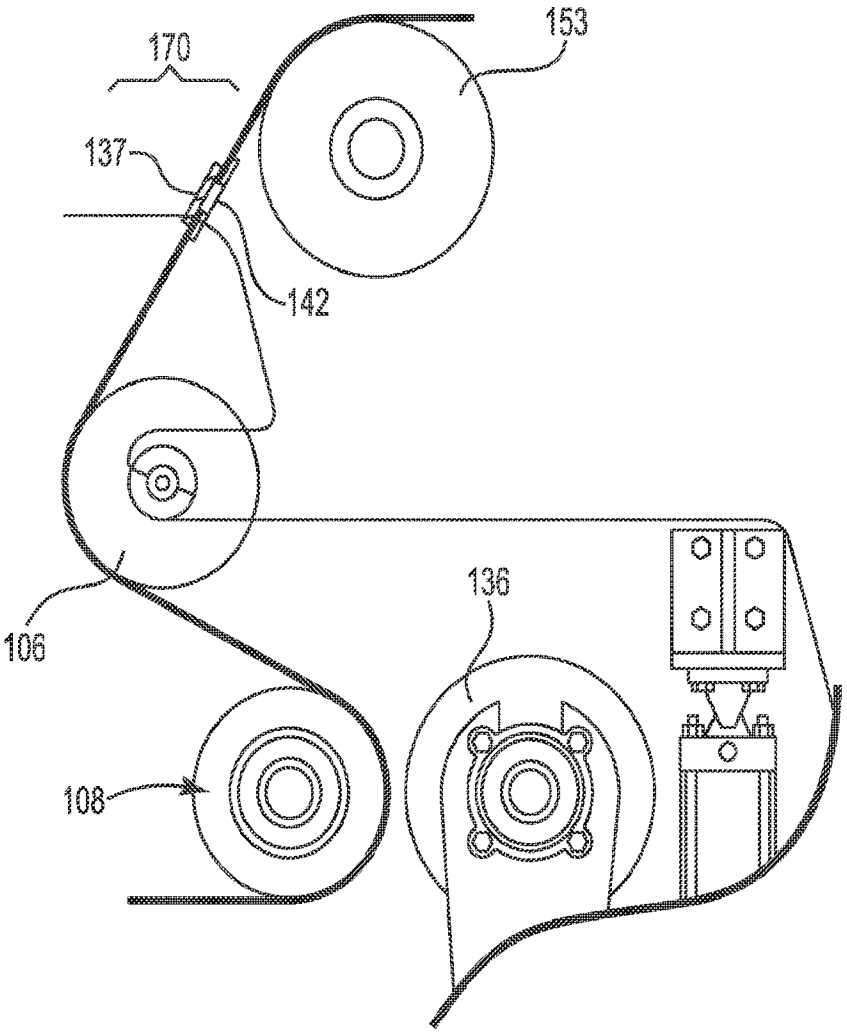
FIG. 8B is a close up view of a completed splice of the present disclosure in the second splicer configuration, according to one or more embodiments.

Turning now to FIGS. 8A and 8B, the completed splice 170 binding outgoing web 102 with replacement web 132 is shown with respect to the first and second configurations of the splicer 100, respectively. FIG. 8A shows the completed splice 170 moving between idle rollers 112 and 114 before exiting the splicer 100. FIG. 8B shows the completed splice 170 moving between idle rollers 106 and 153 before exiting the splicer 100. It may be appreciated that during or after completion of the splice 170, the roll that previously supplied outgoing web 102 may be removed from its feeding position, and the replacement roll 133 may be moved into the feeding position. A second replacement roll may then be arranged in the location previously occupied by replacement roll 133 so as to prepare for a next splice to continue operations after replacement roll 133 becomes depleted or otherwise needs to be spliced with a new roll.

It may be appreciated that portions of the method 200 may be performed automatically while other portions may be performed manually or by a user. For example, a worker may prepare the leading edge 135 of the replacement web 132 with the first adhesive strip 137 in some embodiments (210). Additionally or alternatively, a worker may prepare the splicer roller 136 by attaching the second adhesive strip 142 to the splicer roller (220). Either or both of these preparation steps may be performed, for example, during production at any suitable time before a splice will be needed. That is, the two adhesive strips may be prepared well in advance of the formation of the splice 170. When the splice 170 is to be performed between the two rolls, the remaining steps of method 200 may be initiated manually or automatically, for example.

Figure 9:
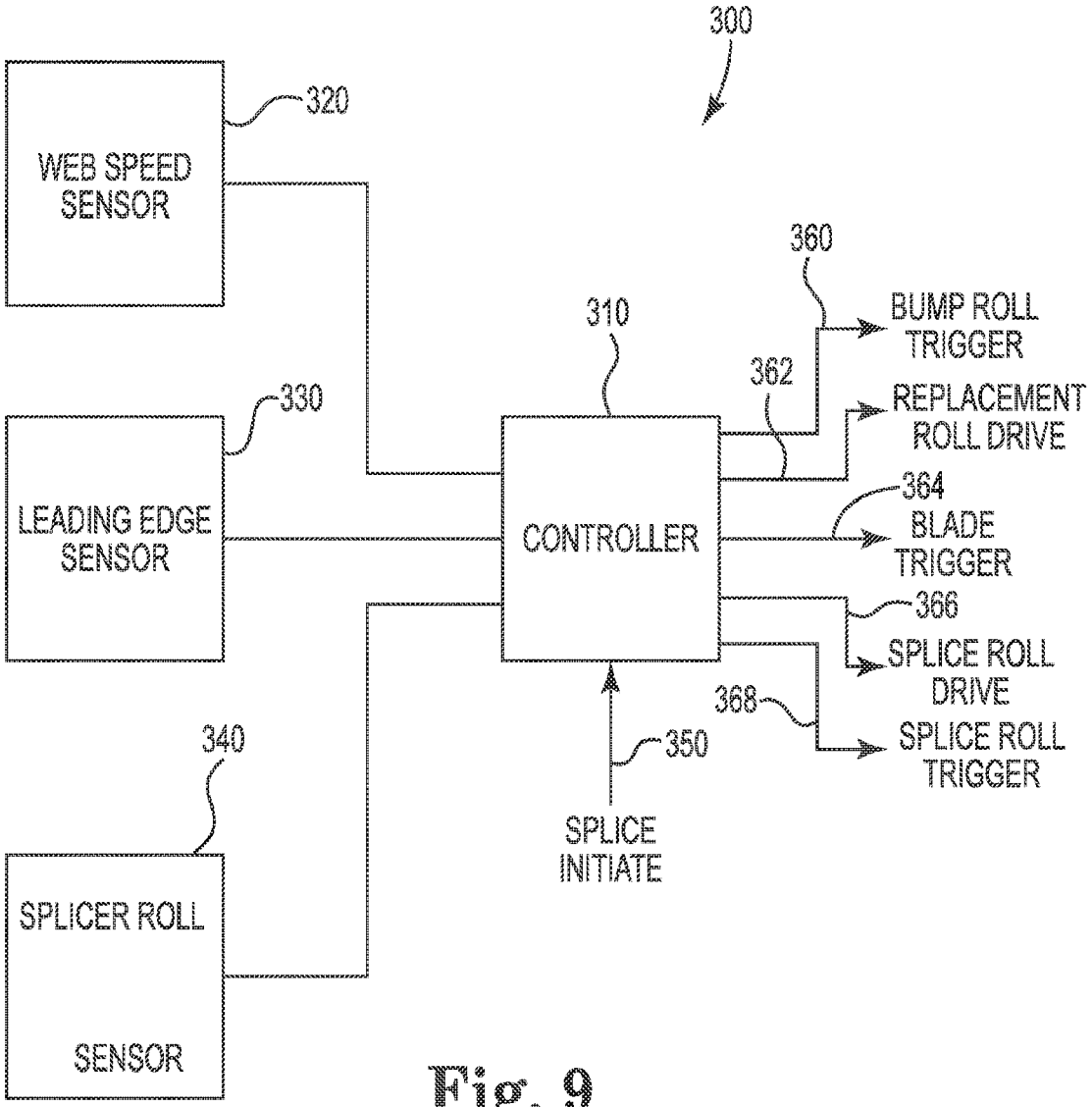
FIG. 9 is a schematic diagram of a system of the present disclosure, according to one or more embodiments.

Turning now to FIG. 9, a system 300 for completing a web splice of the present disclosure is shown. The system 300 may include a controller 310, a web speed sensor 320, a leading edge sensor 330, and a splicer sensor 340. The system 300 may have more, fewer, or different components in some embodiments.

The web speed sensor 320 may be configured to determine or detect a speed of the web 102/132 moving through the splicer 100. The web speed sensor 320 may generally be placed at any suitable location within the splicer 100 or converting or printing line. In some embodiments, the web speed sensor 320 may detect an actual speed of the moving web material. In other embodiments, the web speed may be determined based on a pre-programmed or pre-set speed.

The leading edge sensor 330 may be configured to detect a location of the leading edge 135 of the replacement roll 133. For example, the leading edge sensor 330 may detect a location of the leading edge marker 134 on the replacement roll 133, as discussed above, the leading edge marker 134 having a known relationship to the leading edge 135. The leading edge sensor 330 may use electro-optical, magnetic, radio, or other sensing technologies to determine a location of the leading edge 135 based on the leading edge marker 134. In other embodiments, the location of the leading edge 135 and/or leading edge marker 134 may be determined based on a pre-programmed or pre-set known location. In still other embodiments, other mechanisms may be used to track or determine the location of the leading edge 135 and/or leading edge marker 134.

The splicer sensor 340 may be configured to detect a location of the second adhesive strip 142. For example, the splicer sensor 340 may detect a location of the splicer marker 138 on the splicer roller 136, as discussed above, the splicer marker 138 having a known relationship to the second adhesive strip 142. The splicer sensor 340 may use electro-optical, magnetic, radio, or other sensing technologies to determine a location of the second adhesive strip 142 based on the splicer marker 138. In other embodiments, the location of the second adhesive strip 142 and/or splicer marker 138 may be determined based on a pre-programmed or pre-set known location. In still other embodiments, other mechanisms may be used to track or determine the location of the second adhesive strip 142 and/or splicer marker 138.

The controller 310 may be configured to receive signals and other information, such as sensed information from the web speed sensor 320, leading edge sensor 330, and splicer sensor 340. The controller 310 may additionally receive a splice initiate signal 350. The splice initiate signal 350 may be sent by a user or may be sent automatically based on a sensed or known condition of the outgoing web 102. For example, when the outgoing web 102 is nearly depleted from its roll, a user may send the splice initiate signal 350, or alternatively the system 300 may sense or calculate that the roll is nearly depleted based on roll size, web length, or other parameters, and automatically send the splice initiate signal.

The controller 310 may additionally be configured to send signals or commends for particular actions. For example, when the controller 310 receives the splice initiate signal 350, the controller may send replacement roll drive 362 and splice roll drive 366 signals to accelerate rotation of each of the replacement roll 133 and splicer roller 136, respectively, and as described above. The controller 310 may actuate and/or adjust speed of the drive signals 362, 366 based on input received from the web speed sensor 320, leading edge mark sensor 330, and/or splice mark sensor 340. The controller 310 may further send bump roll trigger signal 360 to actuate movement of the bump roller 104 and cutting blade 116 toward the replacement roll 133. The controller 310 may send blade trigger signal 366 to actuate movement of the cutting blade 116 about pivot 119, such that the outgoing web 102 may be cut. It may be appreciated that the controller 310 may adjust the timing of blade trigger 364 such that the resulting trailing edge 162 of outgoing web 102 may align with respect to the sensed leading edge marker 134 based on input from the leading edge sensor 330 and/or web speed sensor 320. The controller 310 may further send splice roll trigger signal 368 to actuate movement of the splicer roller 136 and splicer roll arm 140 toward the splicer backup roller 108. It may be appreciated that the controller 310 may adjust the position of the adhesive strip 142 by adjusting the position of the splicer roll 136 and the timing of splice roll trigger signal 368 such that the second adhesive strip may pass between the splicer roller 136 and splicer backup roller 108 simultaneously with the partial splice 170' based on input from the splicer sensor 340 and/or web speed sensor 320.

Devices, systems, and methods of the present disclosure may provide for an on-the-fly splice for web material being run through a converting machine or printing machine. The splice may be performed without interrupting the converting machinery or printing machinery, and therefore may lead to efficient splicing with little to no lost production time. In some embodiments, the splice may be performed at the same speed as the converting production speed. Additionally, the splice may be performed automatically or partially automatically. Devices, systems, and methods of the present disclosure may create a stable splice capable of passing through additional rollers or other equipment without issue. For example, a splice of the present disclosure may be a lapless butt splice, thus reducing issues caused by overlapping web material, and may employ upper and lower adhesive strips, so as to avoid the need for a complex butt splice without leaving adhesive material exposed.

For purposes of this disclosure, any system described herein may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, a system or any portion thereof may be a personal computer (e.g., desktop or laptop), tablet computer, programmable logic controller (PLC), mobile device (e.g., personal digital assistant (PDA) or smart phone), server (e.g., blade server or rack server), a network storage device, or any other suitable device or combination of devices and may vary in size, shape, performance, functionality, and price. A system may include random access memory (RAM), one or more processing resources such as a central processing unit (CPU) or hardware or software control logic, ROM, and/or other types of nonvolatile memory. Additional components of a system may include one or more disk drives or one or more mass storage devices, one or more network ports for communicating with external devices as well as various input and output (I/O) devices, such as switches, sensors, a keyboard, a mouse, touchscreen and/or a video display. Mass storage devices may include, but are not limited to, a hard disk drive, floppy disk drive, CD-ROM drive, smart drive, flash drive, or other types of non-volatile data storage, a plurality of storage devices, or any combination of storage devices. A system may include What is referred to as a user interface, which may generally include a display, mouse or other cursor control device, keyboard, button, touchpad, touch screen, microphone, camera, video recorder, speaker, LED, light, joystick, switch, buzzer, bell, and/or other user input/output device for communicating with one or more users or for entering information into the system. Output devices may include any type of device for presenting information to a user, including but not limited to, a computer monitor, flat-screen display, or other visual display, a printer, and/or speakers or any other device for providing information in audio form, such as a telephone, a plurality of output devices, or any combination of output devices. A system may also include one or more buses operable to transmit communications between the various hardware components.

One or more programs or applications, such as a web browser, and/or other applications may be stored in one or more of the system data storage devices. Programs or applications may be loaded in part or in whole into a main memory or processor during execution by the processor. One or more processors may execute applications or programs to run systems or methods of the present disclosure, or portions thereof, stored as executable programs or program code in the memory, or received from the Internet or other network. Any commercial or freeware web browser or other application capable of retrieving content from a network and displaying pages or screens may be used. In some embodiments, a customized application may be used to access, display, and update information.

Hardware and software components of the present disclosure, as discussed herein, may be integral portions of a single computer or server or may be connected parts of a computer network. The hardware and software components may be located within a single location or, in other embodiments, portions of the hardware and software components may be divided among a plurality of locations and connected directly or through a global computer information network, such as the Internet.

As will be appreciated by one of skill in the art, the various embodiments of the present disclosure may be embodied as a method (including, for example, a computer-implemented process, a business process, and/or any other process), apparatus (including, for example, a system, machine, device, computer program product, and/or the like), or a combination of the foregoing. Accordingly, embodiments of the present disclosure may take the form of an entirely hardware embodiment, an entirely software embodiment (including firmware, middleware, microcode, hardware description languages, etc.), or an embodiment combining software and hardware aspects. Furthermore, embodiments of the present disclosure may take the form of a computer program product on a computer-readable medium or computer-readable storage medium, having computer-executable program code embodied in the medium, that define processes or methods described herein. A processor or processors may perform the necessary tasks defined by the computer-executable program code. Computer-executable program code for carrying out operations of embodiments of the present disclosure may be written in an object oriented, scripted or unscripted programming language such as Java, Perl, PHP, Visual Basic, Smalltalk, C++, or the like. However, the computer program code for carrying out operations of embodiments of the present disclosure may also be written in conventional procedural programming languages, such as the C programming language or similar programming languages. A code segment may represent a procedure, a function, a subprogram, a program, a routine, a subroutine, a module, an object, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

In the context of this document, a computer readable medium may be any medium that can contain, store, communicate, or transport the program for use by or in connection with the systems disclosed herein. The computer-executable program code may be transmitted using any appropriate medium, including but not limited to the Internet, optical fiber cable, radio frequency (RF) signals or other wireless signals, or other mediums. The computer readable medium may be, for example but is not limited to, an electronic, magnetic, optical, electromagnetic, infrared, or semiconductor system, apparatus, or device. More specific examples of suitable computer readable medium include, but are not limited to, an electrical connection having one or more wires or a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device. Computer-readable media includes, but is not to be confused with, computer-readable storage medium, which is intended to cover all physical, non-transitory, or similar embodiments of computer-readable media.

Various embodiments of the present disclosure may be described herein with reference to flowchart illustrations and/or block diagrams of methods, apparatus (systems), and computer program products. It is understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks. Alternatively, computer program implemented steps or acts may be combined with operator or human implemented steps or acts in order to carry out an embodiment of the invention.

Additionally, although a flowchart may illustrate a method as a sequential process, many of the operations in the flowcharts illustrated herein can be performed in parallel or concurrently. In addition, the order of the method steps illustrated in a flowchart may be rearranged for some embodiments. Similarly, a method illustrated in a flow chart could have additional steps not included therein or fewer steps than those shown. A method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

We claim:

1. A web splicer for on-the-fly splicing of an outgoing web with a replacement web, the replacement web being in the form of a replacement roll having a leading edge, the web splicer comprising:

a cutting apparatus configured to cut the outgoing web to create a trailing edge;

a bump roller rotatable about a central axis and configured to rotate in communication with the outgoing web, the bump roller arranged proximate to the replacement roll and further configured to press the trailing edge of the outgoing web against a first adhesive surface coupled to a leading edge of the replacement web and creating a gap between the leading edge and the trailing edge;

a splicer backup roller rotatable about a central axis and configured to rotate in communication with the outgoing web; and a splicer roller rotatable about a central axis, arranged proximate to the splicer backup roller, and configured to hold a second adhesive surface, the splicer roller configured to selectively press the second adhesive surface over the gap, wherein the web splicer produces a web splice having the first adhesive surface arranged on a first side of the splice and extending across the gap between the leading edge of the replacement web and the trailing edge of the outgoing web, and the second adhesive surface arranged over the gap.

2. The web splicer of claim 1, further comprising an accelerator configured to accelerate the splicer roller to a speed matching the speed of the outgoing web moving across the splicer backup roller.

3. The web splicer of claim 1, further comprising an actuation element configured to control relative movement between the cutting blade and the outgoing web.

4. The web splicer of claim 1, further comprising an actuation element configured to actuate movement of at least one of the splicer roller and the splicer backup roller, so as to bring the splicer roller and splicer backup roller proximate to one another to press the second adhesive surface over the gap.

5. The web splicer of claim 1, further comprising a system tracking the leading edge of the replacement roll.

6. The web splicer of claim 5, wherein the system comprises a leading edge marker arranged on the replacement roll and having a known relationship to the leading edge.

7. The web splicer of claim 1, further comprising a system for tracking the location of the second adhesive strip.

8. The web splicer of claim 1, wherein the web splicer is configured to form a lapless splice between the outgoing web and the replacement web.

9. The web splicer of claim 1, wherein the web splicer is configured to transition from a first configuration, with the replacement roll in a first position, to a second configuration, with the replacement roll in a second position.

10. A method for splicing a replacement web with an outgoing web on the fly, the method comprising:

accelerating rotation of a replacement roll to match a speed of the outgoing web, the replacement roll having a first adhesive strip affixed to an inner surface of a leading edge of the replacement web, such that a portion of the first adhesive strip remains exposed;

arranging a second adhesive strip on a splicer roller, the splicer roller rotatable about a central axis;

accelerating rotation of the splicer roller to match a speed of the outgoing web;

cutting the outgoing web to form a trailing edge, wherein cutting the outgoing web causes the trailing edge to contact the exposed portion of the first adhesive strip;

pressing the trailing edge onto the first adhesive strip, adjacent to the leading edge and forming a gap; and affixing the second adhesive strip over the gap via the splicer roller.

11. The method of claim 10, wherein pressing the trailing edge onto the first adhesive strip comprises passing the trailing edge, leading edge, and adhesive strip together across a bump roller, wherein the bump roller applies pressure to a surface of the trailing edge.

12. The method of claim 10, wherein affixing the second adhesive strip over the gap via the splicer roller comprises passing the trailing edge and leading edge across a splicer backup roller, and actuating at least one of the splicer roller and the splicer backup roller so as to bring the splicer roller and splicer backup roller proximate to one another to press the second adhesive strip over the gap.

13. The method of claim 10, wherein the method results in a lapless splice between the outgoing web and the replacement web.

14. The method of claim 10, wherein affixing the second adhesive strip over the gap via the splicer roller comprises adjusting a rotational phase of the splicer roller so as to align the second adhesive strip with the first adhesive strip.

15. A system for splicing a replacement web with an outgoing web on the fly, the system comprising:

a plurality of rollers facilitating movement of the outgoing web and replacement web;

a cutting apparatus configured to cut a trailing edge of the outgoing web;

a leading edge sensing system configured for sensing a location of a leading edge of the replacement web;

a first splicer sensing system configured for sensing a location of a first adhesive strip; and a second splicer sensing system configured for sensing a location of a second adhesive strip;

wherein, based on the respective locations of the leading edge, the first adhesive strip, and the second adhesive strip, the system is configured to operate the plurality of rollers and cutting apparatus to form a non-overlapping splice between the trailing edge of the outgoing web and the leading edge of the replacement web.

16. The system of claim 15, the splice is a lap less splice.

17. The system of claim 15, wherein the operation of the plurality of rollers includes accelerating rotation of a splicer roller.

18. The system of claim 17, wherein operation of the plurality of rollers includes adjusting a rotational phase of the splicer roller based on information received from the first or second splicer sensing system.

19. The system of claim 18, wherein operation of the plurality of rollers includes triggering the splicer roller.

* * * * *